US008156779B2

(12) United States Patent
Ohashi et al.

(10) Patent No.: US 8,156,779 B2
(45) Date of Patent: Apr. 17, 2012

(54) APPARATUS AND METHOD OF PRODUCING SPARK PLUG

(75) Inventors: Hiroshi Ohashi, Aichi (JP); Kiyoshi Inoue, Aichi (JP); Masato Nagasaki, Seto (JP); Yasuhiro Hori, Kasugai (JP)

(73) Assignee: NGK Spark Plug Co., Ltd., Aichi (JP)

( * ) Notice: Subject to any disclaimer, the term of this patent is extended or adjusted under 35 U.S.C. 154(b) by 895 days.

(21) Appl. No.: 12/281,659

(22) PCT Filed: Nov. 22, 2007

(86) PCT No.: PCT/JP2007/072688

§ 371 (c)(1),
(2), (4) Date: Sep. 4, 2008

(87) PCT Pub. No.: WO2008/062880

PCT Pub. Date: May 29, 2008

(65) Prior Publication Data

US 2009/0007618 A1 Jan. 8, 2009

(30) Foreign Application Priority Data

Nov. 22, 2006 (JP) ..... 2006-315924
Nov. 16, 2007 (JP) ..... 2007-298520

(51) Int. Cl.
*B21H 3/04* (2006.01)

(52) U.S. Cl. ..... 72/104; 72/10.7; 72/12.1; 72/121

(58) Field of Classification Search ..... 72/10.1, 72/10.3, 10.7, 11.1, 11.2, 11.6, 12.1, 103, 72/104, 108, 120, 121, 125, 88, 90
See application file for complete search history.

(56) References Cited

U.S. PATENT DOCUMENTS 3,017,697 A * 1/1962 Wlodek ..... 72/377
4,322,961 A * 4/1982 Greis ..... 72/95
5,528,917 A * 6/1996 Bajraszewski et al. ..... 72/10.6
5,918,495 A * 7/1999 Miyamoto et al. ..... 72/108
6,418,767 B2 * 7/2002 Shinbutsu et al. ..... 72/10.2
6,915,673 B2 * 7/2005 Shinbutsu et al. ..... 72/104

FOREIGN PATENT DOCUMENTS

EP 0296594 * 12/1988
JP 4-89151 * 3/1992
JP 6-106285 * 4/1994
JP 2001-284015 A 10/2001
JP 2002-143969 A 5/2002
JP 2003-297525 A 10/2003
JP 2003-323963 A 11/2003

* cited by examiner

*Primary Examiner* — Edward Tolan
(74) *Attorney, Agent, or Firm* — Sughrue Mion, PLLC

(57) ABSTRACT

In an apparatus for producing a spark plug, approach driving conditions are calculated on the basis of a specified thrust feeding amount so that, while a temporal overlap occurs between a time period of feed-driving toward a rolling position P2 of a workpiece supporting portion (11) and an approach driving time period, in a circumferential direction of a workpiece W, a positional relationship between the starting position of the threaded portion which is rolling-formed, and the joining position of the ground electrode to the tip end face of the workpiece W is constant. The operation of an approach driving portion is controlled on the basis of the calculated approach driving conditions.

16 Claims, 13 Drawing Sheets

TW: TIME PERIOD REQUIRED UNTIL ROLLING LOAD REACHES PRESET VALUE
TN: TIME PERIOD WHICH ELAPSES UNTIL ROTATION NUMBER OF WORKPIECE IS SYNCHRONIZED WITH ROTATION NUMBER [N] OF DIES

80

(deg)

| SIZE OF SCREW / TYPE OF WORKPIECE | M8 | ..... | M14 |
|---|---|---|---|
| A | a | | c |
| B | b | | d |
| ⋮ | | | |

APPARATUS AND METHOD OF PRODUCING SPARK PLUG

TECHNICAL FIELD

The present invention relates to an apparatus and method of producing a spark plug.

BACKGROUND ART

In a metal shell of a spark plug, usually, a threaded portion for screwing into a cylinder head is formed in an outer peripheral surface by a threading process. Specifically, a spark plug is attached in a form in which a threaded portion formed on a metal shell of the spark plug is screwed into a cylinder head while clamping a gasket between a gasket seat surface of a gas seal portion formed in the metal shell, and a gasket supporting surface of the cylinder head.

In recent automobile engines and the like, in accordance with tighter regulations on exhaust gas, an air-fuel mixture in the lean (rare) region is often used (a so-called lean burn engine). In a lean burn engine, the fuel mixture ratio is low. Depending on the direction of a ground electrode of a spark plug in a combustion chamber, therefore, a spark discharge gap may be hidden behind the ground electrode from a swirl flow (mixture flow) which is generated during the compression stroke in the combustion chamber, and hence ignition failure sometimes occurs. In such an engine, consequently, it is requested to attach a spark plug with adjusting a ground electrode to an optimum position for ignition. In this case, in order to maintain a regular compression stroke of a gasket, the screw advancement distance in attachment of a threaded portion of a metal shell to a cylinder head is limited to a specified range. In order to adjust the ground electrode to a constant angular position in attachment to an engine, the attachment threaded portion must be rolling-formed on the main shell so that the starting angular position is constant with respect to the joining position of the ground electrode.

In order to satisfy the requirement, Patent Reference 1 discloses a spark plug producing apparatus in which a die and a workpiece are previously positioned so that a constant distance corresponding to the rolling starting position in the direction of the screw thrust is formed between an end face which is opposed to a to-be-threaded portion of a gas seal portion, and an end face of the die corresponding to the positioning end face on the side the workpiece. In this apparatus, while the die and the workpiece are relatively rotated after positioning, the die begins the approach toward the outer peripheral surface of the workpiece so that the thread rolling is started at the thread starting position which is specified in accordance with the joining position of the ground electrode. At the time of the application of Patent Reference 1, however, the production of a vehicle on which such spark plugs are mounted is not largely performed, and the production capacity of such an apparatus is not strictly requested.

Patent Reference 1: JP-A-2001-284015

DISCLOSURE OF THE INVENTION

Object that the Invention is to Solve

In Europe and the like, for example, the ratio of diesel vehicles is increasing with the popularization of the common-rail diesel (diesel direct injection) technique. In accordance with this, the development of a direct injection engine which is high in fuel efficiency and output power, and to which an injection mechanism (for example, a piezo injector) of a common-rail diesel is applied is advanced also in a gasoline engine vehicle. In this direct injection engine, more precise fuel injection is required, and the positional limitation of the ground electrode of a spark plug in a state where the spark plug is attached to the engine is more severe. Recently, the kinds of vehicles on which the direct injection engine is mounted are rapidly increased. The production apparatus disclosed in Patent Reference 1 has a problem that the accuracy of the thread rolling starting position and the rolling efficiency are not always sufficient. When a workpiece is attached to a workpiece supporting portion of a rolling apparatus, fore example, there is a possibility that an error occurs in the positioning accuracy of the workpiece in the thrust direction. Furthermore, the die and the workpiece are previously positioned in the thrust direction, and then the approach of the die to the workpiece is started while relatively rotating the die and the workpiece. Therefore, the time period from the setting of the workpiece to the apparatus, to the start of the rolling process is prolonged to cause the rolling efficiency to be lowered.

It is an object of the invention to provide an apparatus for producing a spark plug in which thread rolling is performed in such a manner that the starting position of a threaded portion to be rolling-formed, and the joining position of a ground electrode to the tip end face of a workpiece are made constant, and the formation accuracy of the threaded portion starting position with respect to the ground electrode joining position can be enhanced, and also a method of producing a spark plug which uses the method.

Means for Solving the Object and Effects of the Invention

In order to solve the object, the apparatus for producing a spark plug of the invention comprises:

a workpiece supporting portion which rotatably holds a workpiece about a center axis, the workpiece being a shaft-like workpiece which is to be formed as a metal shell of the spark plug, and in which a gas seal portion is formed on an outer peripheral surface of a basal end side of a to-be-threaded portion while being radially outward projected;

a die which is rotationally driven in a rolling performing direction by die rotation driving means, and which performs a thread rolling process on an outer peripheral surface of the workpiece held by the workpiece supporting portion;

workpiece conveying means for conveying the workpiece supporting portion to which the workpiece is attached, from a retracting position for preparation of rolling to a rolling position which is determined in a form where a predetermined rolling relief gap remains between an end face of the gas seal portion on a side of the to-be-threaded portion, and an end face of the die corresponding to a positioning end face on a side of the workpiece;

approach driving means for, in order to start the thread rolling process, performing an approach drive of relatively approaching the die in a rotationally driven state and the workpiece each other in a radial direction;

rolling relief gap displacement amount specifying means for, in advance of a start of the approach drive, measuring a value of the rolling relief gap formed between the workpiece conveyed to the rolling position and the die, and specifying a rolling relief gap displacement amount which is a displacement amount from a target value of the rolling relief gap;

thrust direction correcting means for thrust-correcting a positional relationship between a threaded portion formed in the die and the workpiece, in a direction along which the specified rolling relief gap displacement amount is eliminated;

approach driving condition calculating means for calculating the approach driving conditions on a basis of the specified rolling relief gap displacement amount so that, in a circumferential direction of the workpiece, a positional relationship between a starting position of the threaded portion which is rolling-formed, and a joining position of a ground electrode to a tip end face of the workpiece is constant; and approach drive controlling means for controlling an operation of the approach driving means on a basis of the calculated approach driving conditions.

Furthermore, the apparatus for producing a spark plug of the invention is characterized in that thread rolling is performed on an outer peripheral surface of a metal shell by using the above-described apparatus for producing a spark plug of the invention.

According to the invention, in advance of the start of the approach drive, the value of the rolling relief gap formed between the workpiece conveyed to the rolling position and the die is measured, the rolling relief gap displacement amount which is a displacement amount of the rolling relief gap from the target value is specified, and the positional relationship between the threaded portion formed in the die and the workpiece is thrust-corrected in the direction along which the specified rolling relief gap displacement amount is eliminated. Then, the approach driving conditions are calculated on the basis of the specified rolling relief gap displacement amount so that, in the circumferential direction of the workpiece, the positional relationship between the starting position of the threaded portion which is formed by rolling, and the joining position of the ground electrode to the tip end face of the workpiece is constant. The operation of the approach driving means is controlled on the basis of the calculated approach driving conditions. Namely, the displacement amount of the rolling relief gap when the workpiece supporting portion to which the workpiece is set is conveyed to the rolling position is specified, and, by using the rolling relief gap displacement amount, the approach driving conditions for relatively approaching the die to the workpiece outer peripheral surface are corrected so that the positional relationship between the starting position of the threaded portion and the ground electrode joining position is constant. Even when, at setting of a workpiece, the position of the workpiece supporting portion in the thrust direction is dispersed, the rolling relief gap displacement amount is specified each time, and the approach driving conditions are calculated by using this. Therefore, the dispersion hardly affects the formation accuracy of the thread starting position with respect to the ground electrode joining position.

The approach drive controlling means can be configured so as to control the approach drive controlling means controls the operation of the approach driving means so that a temporal overlap occurs between a time period of execution of the approach drive and a time period of execution of the thrust correction. When the approach driving conditions in which the correction of the rolling relief gap displacement amount is considered are previously calculated, the thrust correction of the positional relationship between the workpiece and the die, and the approach driving operation of the die can be performed in parallel. As a result, the time period required from the setting of the workpiece to the apparatus, to start of the rolling process can be shortened, and the rolling efficiency can be improved.

The workpiece conveying means can be configured as thrust feed driving means for feed-driving the workpiece supporting portion to which the workpiece is attached, from the retracting position for preparation of rolling in a thrust direction, to convey the workpiece supporting portion to the rolling position which is determined in the form where the predetermined rolling relief gap remains between the end face of the gas seal portion on the side of the to-be-threaded portion, and the end face of the die corresponding to the positioning end face on the side of the workpiece. There is an advantage that a workpiece conveying mechanism can be simply configured by a reciprocating mechanism in the thrust direction. In this case, the thrust direction correcting means can be configured so as to drive the workpiece supporting portion by means of the thrust feed driving means in the direction along which the rolling relief gap displacement amount is eliminated. When the workpiece itself is moved in the thrust direction, the above-mentioned thrust correction can be performed surely and simply. By contrast, the thrust direction correcting means can correct a rotation angle phase of the die at starting of the approach driving in the direction along which the rolling relief gap displacement amount is eliminated. Namely, when the rotation angle phase of the die at starting of the rolling process is changed, the starting position of the threaded portion to be rolled can be relatively corrected with respect to the workpiece in the thrust direction. Therefore, the correction of the rolling relief gap displacement amount can be incorporated into the rotation driving of the die, and, even when the thrust feeding of the workpiece is not performed, the above-mentioned thrust correction can be made.

By contrast, the workpiece conveying means can be configured so as to convey the workpiece from the retracting position which, when a reference plane defined by a rotation axis of the die and a center axis of the workpiece which are parallel to each other at the rolling position is considered, is defined to be separated from the rolling position in a direction intersecting the reference plane, to the rolling position. According to the configuration, it is not required to ensure a large space for retracting the workpiece behind the rotation axis of the die, and hence there is an advantage that the whole apparatus can be compactified.

The workpiece conveying means can be configured so as to, in order to convey the workpiece supporting portion to which a workpiece is attached, from a retracting position for preparation of rolling to a rolling position which is determined in a form where a constant rolling relief gap remains between an end face of a gas seal portion on a side of a to-be-threaded portion, and an end face of the die corresponding to a positioning end face on a side of the workpiece, convey the workpiece from a retracting position which, when a reference plane defined by a rotation axis of the die and a center axis of the workpiece which are parallel to each other at the rolling position is considered, is defined to be separated from the rolling position in a direction intersecting the reference plane, to the rolling position while holding an axial direction position which gives a constant rolling relief gap. According to the system, at the retracting position, the workpiece conveying means previously executes axial positioning for forming the constant rolling relief gap, and conveys the workpiece to the rolling position while holding the axial direction position. Therefore, it is not necessary to, after the workpiece is once conveyed to the rolling position, specify the rolling relief gap displacement amount which is a displacement amount of the rolling relief gap from the target value. Namely, there is an advantage that the rolling relief gap displacement amount specifying means and the thrust direction correcting means are not essential.

In this case, as a reference invention, the apparatus for producing a spark plug may be configured in the following manner. Namely, the configuration comprises:

a workpiece supporting portion which rotatably holds a workpiece about a center axis, the workpiece being a shaft-like workpiece which is to be formed as a metal shell of the spark plug, and in which a gas seal portion is formed on an outer peripheral surface of a basal end side of a to-be-threaded portion while being radially outward projected;

a die which is rotationally driven in a rolling performing direction by die rotation driving means, and which performs a thread rolling process on an outer peripheral surface of the workpiece held by the workpiece supporting portion;

workpiece conveying means for, in order to convey the workpiece supporting portion to which a workpiece is attached, from a retracting position for preparation of rolling to a rolling position which is determined in a form where a constant rolling relief gap remains between an end face of a gas seal portion on a side of a to-be-threaded portion, and an end face of the die corresponding to a positioning end face on a side of the workpiece, conveying the workpiece from a retracting position which, when a reference plane defined by a rotation axis of the die and a center axis of the workpiece which are parallel to each other at the rolling position is considered, is defined to be separated from the rolling position in a direction intersecting the reference plane, to the rolling position while holding an axial direction position which gives a constant rolling relief gap;

approach driving means for, in order to start the thread rolling process, performing an approach drive of relatively approaching the die in a rotationally driven state and the workpiece each other in a radial direction;

approach driving condition calculating means for calculating approach driving conditions on a basis of the rolling relief gap displacement amount so that, in a circumferential direction of the workpiece, a positional relationship between a starting position of the threaded portion which is rolling-formed, and a joining position of a ground electrode to a tip end face of the workpiece is constant; and approach drive controlling means for controlling an operation of the approach driving means on a basis of the calculated approach driving conditions.

Specifically, the workpiece conveying means can be configured so as to have: a turret which is placed rotatably about a rotation axis that perpendicularly intersects a predetermined position on an extension of the workpiece center axis on a side where the workpiece-side positioning end face of the die, in a plane passing through the workpiece center axis at the rolling position and intersecting the reference plane;

the workpiece supporting portion which is placed in plural numbers, in an outer peripheral edge portion of the turret, and at predetermined angular intervals in a circumferential direction of the turret, each of the workpiece supporting portions supporting the workpiece in a rotation radial direction of the turret so that the to-be-threaded portion is projected from an outer peripheral surface of the turret in the rotation radial direction; and a turret driving portion which rotationally drives the turret in an intermittent manner about the rotation axis so that the workpiece attached to one of the plural workpiece supporting portions is positioned at the rolling position, while setting placement angular intervals of the workpiece supporting portions as units. Because of the intermittent rotation drive of the turret, plural workpieces can be efficiently conveyed to the rolling position, and the workpiece which has undergone the rolling process can be rapidly discharged from the rolling position. The workpiece attaching process can be performed in parallel on a workpiece supporting portion which departs from the rolling position, by means of off-line setup while continuing the thread rolling process on the workpiece at the rolling position. Therefore, the efficiency of the thread rolling process for a spark plug can be greatly improved.

In the turret, plural workpiece attachment recesses which are opened in the outer peripheral surface of the turret can be formed in a shape in which the rotation radial direction is set as the depth direction. In the workpiece attachment recesses, moreover, the workpiece supporting portions can be projectingly placed from respective recess bottoms toward respective recess openings so that positions of the gas seal portions of the supported workpieces in the rotation radial direction are constant. The positions of the gas seal portions can be adjusted so that the above-mentioned rolling relief gap when the workpiece is conveyed to the rolling position has a value corresponding to the target value. Therefore, the adjustment of the workpiece position corresponding to the target value of the rolling relief gap is completed in a stage where the workpiece is attached to the workpiece supporting portion of a workpiece attachment recess which is not at the rolling position, and the correction amount in the thrust direction at the rolling position can be greatly reduced (particularly, there is an advantage that sufficient correction is enabled simply by adjusting the rotation angle phases of the die at start of approach driving).

On the other hand, the workpiece conveying means can be configured so as to have: a workpiece holder in which plural workpiece attaching portions for attaching the workpiece are placed and formed on a cylindrical face in which a workpiece center axis at the rolling position is one of generatrices, in parallel to a center axis of the cylindrical face, and at predetermined intervals in the circumferential direction of the cylindrical face so that positions of the gas seal portions on the center axis direction are constant; and a workpiece holder driving portion which rotationally drives the workpiece holders in an intermittent manner about the center axis of the cylindrical face so that the workpiece attached to one of the plural workpiece supporting portions is positioned at the rolling position, while setting placement angular intervals of the workpiece supporting portions as units. Also in this system, substantially same effects as those in the above-described case where the turret is used can be achieved. The individual workpiece attaching portions on the workpiece holder are used for attaching and holding workpieces so that the positions of the gas seal portions are constant (irrespective of the workpiece supporting portion). Therefore, the workpiece supporting portion can be disposed for the workpiece situated at the rolling position among workpieces on the workpiece holder. When the workpiece supporting portion is placed reciprocable between a preparation position which is situated behind a rear end face of the workpiece in a direction of the center axis of the workpiece, and a support position where the workpiece is supported from a side of the rear end face, the workpiece can be previously positioned by the workpiece supporting portion, at an approximate position where the position of the gas seal portion corresponds to the target value of the rolling relief gat. When, in this state, the workpiece supporting portion is coupled to the workpiece for the purpose of rolling, therefore, the final correction amount of the rolling relief gap can be made very small.

The workpiece conveying means can be configured so as to have a workpiece reciprocating mechanism which reciprocates a workpiece gripping portion which is to grip the workpiece, and a workpiece gripping portion which grips the workpiece, between the retracting position and the rolling position. In this case, the thrust direction correcting means can be configured so as to have workpiece gripping portion driving means for, at the rolling position, correction driving the workpiece gripping portion which grips the workpiece in the direction along which the rolling relief gap displacement amount is eliminated in the direction of the center axis of the workpiece.

The workpiece supporting portion can be configured so as to hold the workpiece integrally rotatably, and so that a phase of a holding angle of the ground electrode joining position of the workpiece about a rotation axis is constant. When the workpiece is set, the phase of the holding angle of the ground electrode joining position with respect to the workpiece supporting portion is not dispersed. Therefore, the calculation of the approach driving conditions for maintaining a regular positional relationship between the starting position of the threaded portion and the joining position of the ground electrode can be further simplified.

On the other hand, the workpiece supporting portion can be configured so as to hold the workpiece integrally rotatably, and so that a phase of a holding angle of the ground electrode joining position of the workpiece about the rotation axis is arbitrary. In this case, ground electrode joining position angle specifying means for specifying an attachment angular position of the ground electrode joining position of the workpiece attached to the workpiece supporting portion, with respect to the workpiece supporting portion is disposed, and the approach driving condition calculating means calculates the approach driving conditions on the basis of the specified attachment angular position and the rolling relief gap displacement amount. In the configuration, in the calculation of the approach driving conditions, the attachment angular position of the ground electrode joining position which is indefinite at the attachment of the workpiece must be measured, and the position must be calculated and incorporated into the approach driving conditions. In the configuration, however, it is not required to attach workpieces in a form where their ground electrode joining positions are aligned with one another. Therefore, the efficiency of feeding workpieces to the apparatus can be enhanced.

The approach driving means can be configured so as to cause the die and the workpiece to relatively approach and separate each other between the retracting position where the die is separated from the outer peripheral surface of the workpiece in the radial direction, and the rolling position where the die is butted against the outer peripheral surface of the workpiece to perform the thread rolling process. In this case, while setting three of: an approach driving distance which is a distance in a radial direction between an approach retracting position and the rolling position; a relative approaching velocity or acceleration of the die with respect to the workpiece; a rotation angle phase of the die at starting of the approach driving; and a rotation velocity of the die, as stipulated constant values, and setting a remaining one as a variable value corresponding to the rolling relief gap displacement amount, the approach driving condition calculating means can perform calculation and determination on the basis of the rolling relief gap displacement amount and the three stipulated values. According to the configuration, an influence caused by dispersion of the rolling relief gap displacement amount can be absorbed by one of the approach driving distance, the relative approaching velocity (or acceleration), the rotation angle phase of the die at starting of the approach, and the rotation velocity of the die, the one being to be set as a variable value. Therefore, the calculation of the approach driving conditions can be greatly simplified.

Specifically, the approach driving condition calculating means can be configured so as to, while setting the approach driving distance constant, setting two of: the relative approaching velocity or acceleration of the die with respect to the workpiece; the rotation angle phase of the die at starting of the approach driving; and the rotation velocity of the die, as stipulated values, and setting a remaining one as a variable value corresponding to the rolling relief gap displacement amount, perform calculation and determination on the basis of the two stipulated values, the approach driving distance, and the rolling relief gap displacement amount. According to this method, the approach driving distance is made constant, and hence at least one of the relative approaching velocity (or acceleration) of the die and rotation velocity of the die in which a variable control algorithm is slightly complicated can be made constant. Therefore, a control program can be simplified.

In this case, a configuration in which, while setting the relative approaching velocity (or acceleration) of the die with respect to the workpiece and the rotation velocity of the die as stipulated values, the rotation angle phase of the die at starting of the approach driving is calculated and determined as a variable value corresponding to the rolling relief gap displacement amount is preferable from the viewpoint of further simplification of the control program. Since both the relative approaching velocity (or acceleration) of the die with respect to the workpiece and the rotation velocity of the die are constant, a shock load applied when the die bumps against the workpiece is hardly dispersed, thereby producing an advantage that the quality of the threaded portion to be rolled can be uniformalized.

The approach driving condition calculating means can be configured also so as to set the rotation angle phase of the die at starting of the approach driving, and the relative approaching velocity or acceleration of the die with respect to the workpiece as stipulated values, and calculate and determine the rotation velocity of the die as a variable value corresponding to the rolling relief gap displacement amount. Also, a configuration in which the rotation angle phase of the die at starting of the approach driving, and the rotation velocity of the die are set as stipulated values, and the relative approaching velocity or acceleration of the die with respect to the workpiece is calculated and determined as a variable value corresponding to the rolling relief gap displacement amount is possible.

On the other hand, the approach driving condition calculating means can be configured also so as to set the relative approaching velocity or acceleration of the die with respect to the workpiece, the rotation angle phase of the die at starting of the approach driving, and the rotation velocity of the die as stipulated values, and calculate and determine the approach driving distance as a variable value corresponding to the rolling relief gap displacement amount. Also in this case, both the relative approaching velocity (or acceleration) of the die with respect to the workpiece and the rotation velocity of the die are constant, and hence a shock load applied when the die bumps against the workpiece is hardly dispersed, so that the quality of the threaded portion to be rolled can be uniformalized. In addition, also the rotation angle phase of the die at starting of the approach driving is constant, and therefore the control program can be further simplified.

Next, the approach driving condition calculating means can be configured so as to have angle slip amount specifying means for specifying an angle slip amount of the die with respect to the workpiece in a case where, for the thread rolling, the die bites the workpiece, and calculate the approach driving conditions while correcting in accordance with the angle slip amount. Since the angle slip amount of the die in the case where the die bites the outer peripheral surface of the workpiece is corrected, the positional relationship between the starting position of the threaded portion to be rolling-formed, and the joining position of the ground electrode to the tip end face of the workpiece can be held further accurately.

In this case, as the angle slip amount is larger, the slip time period required until the die finally bites the workpiece to be synchronously rotated is more prolonged. In order to absorb the slip time period, therefore, it is effective to correct the relative approaching velocity (or acceleration) of the die with respect to the workpiece in accordance with the slip time period.

In the case where the reproducibility of the angle slip amount is relatively high depending on the type of the workpiece (particularly, the size and material of the workpiece), the angle slip amount specifying means can be configured so as to have: workpiece type specifying information means for obtaining workpiece type specifying information which specifies a type of the workpiece to be used in the thread rolling; and means for storing an angle slip amount map in which the type of the workpiece is correlated with the angle slip amount that is previously specified for each type, and search an angle slip amount corresponding to the obtained workpiece type, on the angle slip amount map, thereby specifying the angle slip amount. According to the configuration, the angle slip amount can be easily specified in accordance with the workpiece type.

Next, in the apparatus for producing a spark plug of the invention, thread starting position accuracy reflecting parameter obtaining means for obtaining a value of a thread starting position accuracy reflecting parameter which is an apparatus parameter that reflects a starting position accuracy with respect to the ground electrode joining position of the threaded portion to be rolling-formed, rolling determining means for determining whether the thread rolling was adequately performed or not, on the basis of a value of an obtained rolling completion reflecting parameter, and selection outputting means for selecting a thread rolling completed workpiece or assisting the selection, on the basis of a result of the determination can be disposed. According to the configuration, even when the workpiece which has actually undergone the thread rolling process is not checked, the pass/fail of the thread rolling can be easily determined (or estimated) on the basis of the thread starting position accuracy reflecting parameter, simply by obtaining the thread starting position accuracy reflecting parameter from the apparatus. Therefore, the simplicity and efficiency of a process of checking or selecting a failed product can be greatly improved.

The thread starting position accuracy reflecting parameter obtaining means can be configured so as to obtain an angular position of the die at completion of the approach drive, as the thread starting position accuracy reflecting parameter. The angular position indicates the angular position of the die with respect to the workpiece outer peripheral surface. Depending on whether the value indicates an abnormal value or not, the occurrence of a failure of the relative positional relationship with respect to the joining position of the ground electrode to the tip end face of the workpiece can be directly specified.

The thread starting position accuracy reflecting parameter obtaining means can be configured so as to obtain an apparatus parameter that reflects an angle slip amount of the die with respect to the workpiece in a case where, for the thread rolling, the die bites the workpiece, as the thread starting position accuracy reflecting parameter. In the case where the angle slip amount of the die with respect to the workpiece is excessively generated, the above-mentioned angular position of the die has an abnormal value. With respect to the starting position of a threaded portion to be rolling-formed, therefore, the occurrence of a failure of the relative positional relationship with respect to the joining position of the ground electrode to the tip end face of the workpiece can be easily determined.

Specifically, the thread starting position accuracy reflecting parameter obtaining means can be configured so as to have rolling load detecting means for detecting a rolling load which is applied from the die to the workpiece, and obtain a time period required until the rolling load reaches a predetermined determination reference value, as an apparatus parameter which reflects the angle slip amount with respect to the workpiece. On the other hand, the thread starting position accuracy reflecting parameter obtaining means can be configured so as to have rotation velocity detecting means for detecting rotation velocities of the die and the workpiece, and, on the basis of a result of detection of the rotation velocities, obtain a time period which elapses from start of rotation of the workpiece by co-rotation due to rolling start until the die and the workpiece are synchronously rotated, as an apparatus parameter which reflects the angle slip amount with respect to the workpiece. Both the cases indicate that, as this time period is longer, the angle slip amount is larger. The degree of the angle slip amount can be easily determined on the basis of the temporal change of the rolling load.

DESCRIPTION OF REFERENCE NUMERALS AND SIGNS

W workpiece

W0' to-be-threaded portion

4 microcomputer controlling portion (approach driving condition calculating means, approach driving controlling means, thread starting position accuracy reflecting parameter obtaining means, rolling determining means)

11 workpiece supporting portion

12 workpiece set detecting sensor (ground electrode joining position angle specifying means)

25A, 25B motor (die rotation driving means)
27A, 27B die
35A, 35B motor (approach driving means)
55 motor (workpiece conveying means, thrust feed driving means)
56 angle sensor (rolling relief gap displacement amount specifying means)
71 gas seal portion
90 camera (rolling relief gap displacement amount specifying means)

BEST MODE FOR CARRYING OUT THE INVENTION

Hereinafter, an embodiment of the invention will be described with reference to the drawings.

Figure 1:
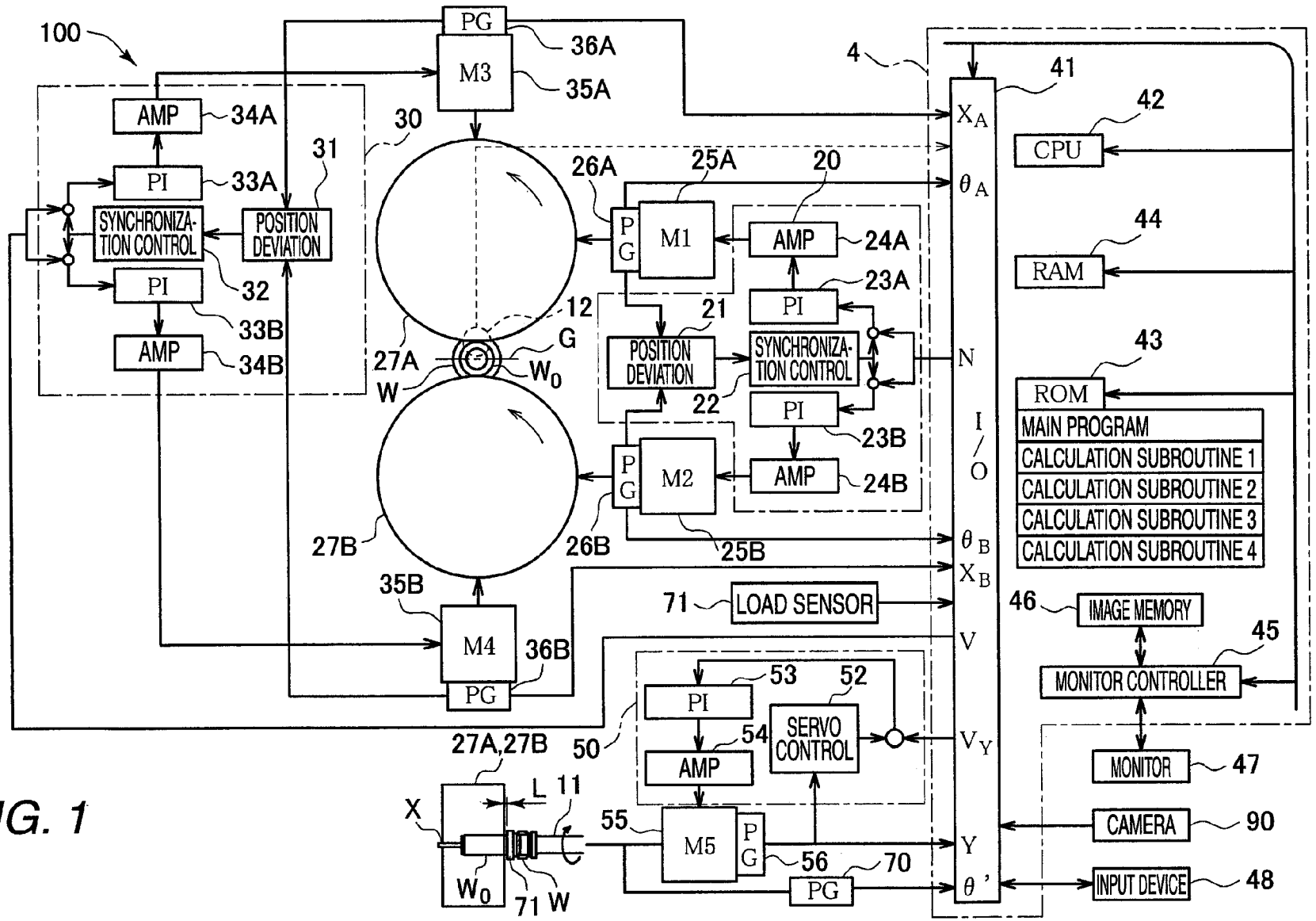
FIG. 1 is a block diagram showing an embodiment of the spark plug producing apparatus of the invention.

Hereinafter, an embodiment of the invention will be described with reference to an example shown in the drawings. FIG. 1 is a block diagram showing the basic configuration of a spark plug producing apparatus which is an embodiment of the invention. In the example, a shaft-like workpiece which is to be formed as a tubular metal shell for a spark plug (hereinafter, often referred to merely as metal shell) is used as a shaft-like workpiece W, and a threaded portion W0 is formed in the outer peripheral surface. In the workpiece W, a gas seal portion 71 which is radially outward projected is formed on the outer peripheral surface of the basal end side of a to-be-threaded portion W0', and a ground electrode material X which is to be formed as a ground electrode is weldedly joined to the tip end face. The ground electrode material X does not have the final form of the ground electrode in which the material is bent toward the center electrode, but has a straight rod-like shape which is attained before bending.

The spark plug producing apparatus 100 has: a workpiece supporting portion 11 which supports the workpiece W so as to be rotatable about the center axis; and dies 27A, 27B which are rotationally driven in the rolling performing direction by motors 25A, 25B (die rotation driving means), and which perform a thread rolling process on the outer peripheral surface of the workpiece W held by the workpiece supporting portion 11.

The workpiece supporting portion 11 is configured as, for example, a mandrel stopper which inwardly holds the workpiece W by means of an elastic member such as a spring, and inserted into the side of an opening which is opposite to the side of the workpiece W where the ground electrode material X is joined. A workpiece set detecting sensor 12 which detects the angular position of the ground electrode material X of the workpiece W attached to the workpiece supporting portion 11 is disposed. The workpiece set detecting sensor 12 is configured by a contact sensor such as a limit switch, a non-contact sensor such as a photoelectric sensor or a proximity switch, or imaging means for software processing such as image analysis. In this case, while positioning of the ground electrode material X is not particularly performed, the workpiece W can be attached to the workpiece supporting portion 11 at an arbitrary angle phase. Alternatively, when an alignment apparatus (not shown) is incorporated into a workpiece feeder, the workpiece W may be set to the workpiece supporting portion 11 so that (the joining position of) the ground electrode material X is always constant.

The spark plug producing apparatus 100 further has thrust feed driving means which reciprocally drives the workpiece supporting portion 11 between a retracting position P1 where the workpiece W is set to the workpiece supporting portion 11, and a rolling position P2 which is determined in a form where a rolling relief gap L of a constant size remains between an end face of the gas seal portion 71 on the side of the to-be-threaded portion W0', and end faces of the dies 27A, 27B corresponding to the positioning end face on the side of the workpiece W. The thrust feed driving means constitutes workpiece conveying means, and is configured by a motor 55, a screw shaft mechanism which is rotationally driven by the motor 55, and which is not shown, etc. The feeding position of the workpiece supporting portion 11 (i.e., the workpiece W) in the thrust direction is detected by an angle sensor (in the embodiment, an absolute rotary encoder) 56 which is disposed on the rotation shaft of the motor 55. The rolling relief gap L is imaged by a camera 90 (rolling relief gap displacement amount specifying means) which images the gap L in a workpiece radial direction, and a rolling relief gap displacement amount L' which is the displacement from the target value is specified. For example, the rolling relief gap displacement amount L' is produced by an error in the thrust direction in attachment of the workpiece W to the workpiece supporting portion 11.

The motor 55 is connected to a servo unit 50, and servo driven in accordance with a velocity command value Vy supplied from a microcomputer controlling portion 4 which will be described later. The servo unit 50 has: a servo controlling portion 52 which receives an angle sensing output from the angle sensor 56, and which compares a current velocity value of the motor indicted by the angle sensing input value, with the velocity command value Vy to output the difference value; a P1 processing portion 53 which generates a drive instructing voltage value on the basis of the difference value; and a servo amplifier 54 which amplifies the drive instructing voltage value supplied from the PI processing portion 53, and which outputs the amplified value as the driving voltage for the motor 55.

In the dies 27A, 27B, multiple (for example, five) thread screws are formed in the outer peripheral surfaces having substantially identical diameters, respectively. The concave-convex portions of the screws are pressed against the outer peripheral surface of the workpiece W, and the dies are rotationally driven by the motors 25A, 25B in a synchronous manner, whereby a threaded portion is rolling-formed in the workpiece W. The rotation angle phases of the dies 27A, 27B are detected by angle sensors 26A, 26B (in the embodiment, absolute rotary encoders) attached to the motor shafts of the motors 25A, 25B.

The motors 25A, 25B are connected to a synchronization control servo unit 20, and synchronous servo driven in accordance with a velocity command value N supplied from the microcomputer controlling portion 4 which will be described later. In the embodiment, the motor 25A is defined as a master, and the motor 25B is defined as a slave. In the servo unit 20, angle detection outputs from the angle sensors 26A, 26B are supplied to an angle deviation detecting portion 21. The angle deviation detecting portion 21 detects an angle deviation of the slave motor 25B with respect to the master motor 25A, from the supplied angle detection outputs, and supplies the deviation to a synchronization controlling portion 22. The synchronization controlling portion 22 compares the current velocity value of the motor indicted by the angle sensing input values, with the velocity command value N while correcting the angle deviation so as to approach zero, and outputs the difference value. The servo unit has: PI (proportional/integral) processing portions 23A, 23B which generate a drive instructing voltage value on the basis of the difference value; and servo amplifiers 24A, 24B which amplify the drive instructing voltage values supplied from the P1 processing portions 23A, 23B, and which output the amplified values as the driving voltages for the motors 25A, 25B.

In order to start the thread rolling process, moreover, approach driving means for driving the dies 27A, 27B in the rotationally driven state to approach and separate in a radial direction from the outer peripheral surface of the workpiece W is disposed. The approach driving means performs synchronous and reciprocal driving on individual head stocks which rotatably support the dies 27A, 27B, respectively, and which are not shown, by means of motors 35A, 35B via screw shaft mechanisms or the like. The positions of the dies 27A, 27B in the approaching direction (radial direction) are detected by angle sensors 36A, 36B (in the embodiment, absolute rotary encoders) attached to the motor shafts of the motors 35A, 35B.

The motors 35A, 35B are connected to a synchronization control servo unit 30, and synchronous servo driven in accordance with a velocity command value V supplied from the microcomputer controlling portion 4 which will be described later. In the embodiment, the motor 35A is defined as a master, and the motor 35B is defined as a slave. In the servo unit 30, angle detection outputs from the angle sensors 36A, 36B are supplied to an angle deviation detecting portion 31. The angle deviation detecting portion 31 detects an angle deviation of the slave motor 35B with respect to the master motor 35A, from the supplied angle detection outputs, and supplies the deviation to a synchronization controlling portion 32. The synchronization controlling portion 32 compares the current velocity value of the motor indicted by the angle sensing input values, with the velocity command value V while correcting the angle deviation so as to approach zero, and outputs the difference value. The servo unit has: P1 processing portions 33A, 33B which generate a drive instructing voltage value on the basis of the difference value; and servo amplifiers 34A, 34B which amplify the drive instructing voltage values supplied from the PI processing portions 33A, 33B, and which output the amplified values as the driving voltages for the motors 35A, 35B.

Next, the spark plug producing apparatus 100 has the microcomputer controlling portion 4. The microcomputer controlling portion 4 has an electric configuration in which a CPU 42 that is a main unit of control, a RAM 44 that functions as a work memory therefor, a ROM 43 that stores a control program, and an input/output portion 41 are interconnected through an internal bus. A monitor controller 45 which outputs display data transferred through the internal bus, to a monitor 47 via an image memory 46 is connected to the internal bus. Digital bit codes of current angular positions $\theta_A$, $\theta_B$, $X_A$, $X_B$, and Y which are output from the angle sensors 26A, 26B, 36A, 36B, and 56 of the motors 25A, 25B, 35A, 35B, and 55 are input to the input/output portion 41. An input device 48 configured by a touch panel, a keyboard, a mouse, and the like is connected to the input/output portion 41.

The control program stored in the ROM 43 realizes the following functions.

Rolling relief gap displacement amount specifying means: measures, in advance of the start of the approach drive, the value L of a rolling relief gap formed between the workpiece conveyed to the rolling position and the dies, by the camera 90, and calculates the rolling relief gap displacement amount L' which is a displacement amount of the rolling relief gap from the target value.

Thrust direction correcting means: thrust-corrects the positional relationships between the threaded portions formed in the dies 27A, 27B and the workpiece W, in the direction along which the specified rolling relief gap displacement amount is eliminated. Either of the case where the workpiece supporting portion 11 is correction driven in the direction along which the rolling relief gap displacement amount L' is eliminated, or that where the rotation angle phases of the dies 27A, 27B at the starting of the approach driving are corrected in the direction along which the rolling relief gap displacement amount L' is eliminated may be employed.

Approach driving condition calculating means: calculates approach driving conditions on the basis of the specified rolling relief gap displacement amount L' so that, in the circumferential direction of the workpiece W, the positional relationship between the starting position of the threaded portion which is rolling-formed, and the joining position of the ground electrode to the tip end face of the workpiece W is constant.

Approach drive controlling means: controls the operations of the motors 35A, 35B on the basis of the calculated approach driving conditions. The approach driving of the dies 27A, 27B with respect to the workpiece W, and the above-described thrust correction are performed in parallel.

Figures 9, 10:
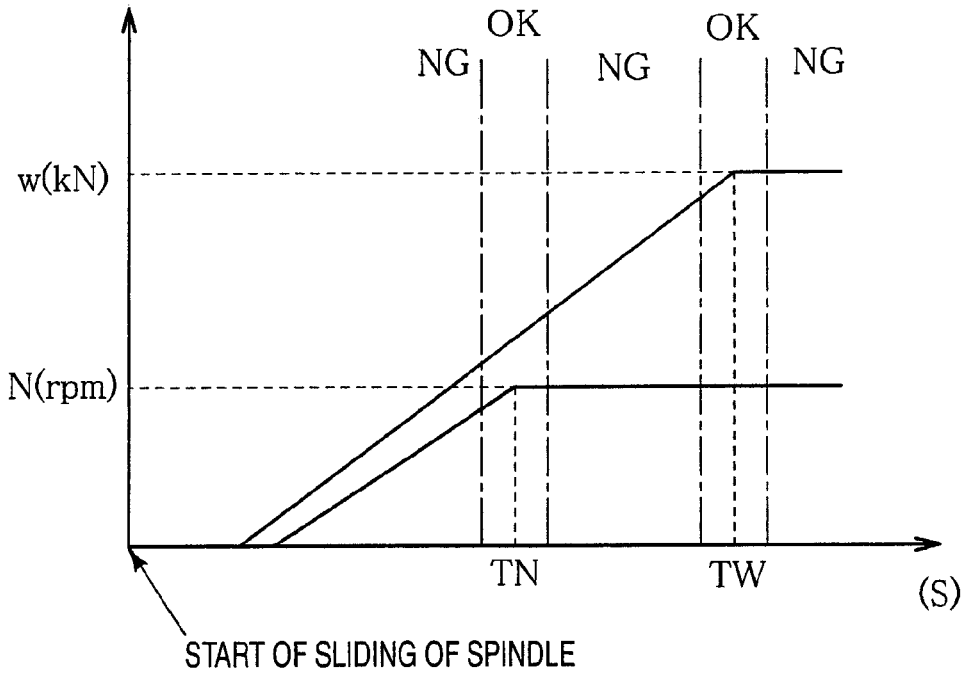
FIG. 9 is a view showing pass/fail determining conditions of a workpiece.
FIG. 10 is a conceptual diagram of an angular slip amount map

Angle slip amount specifying means: specifies the angle slip amount δ of the dies 27A, 27B with respect to the workpiece W in the case where, for the thread rolling, the dies 27A, 27B bite the workpiece W. Specifically, workpiece W type specifying information which specifies the type of the workpiece W to be used in the thread rolling is obtained from, for example, the input portion 48 or a network (not shown) (workpiece W type specifying information means), and the angle slip amount δ corresponding to the type of the workpiece W is searched on an angle slip amount map 80, thereby specifying the angle slip amount. As shown in FIG. 10, the angle slip amount map 80 stores the types of workpieces W and angle slip amounts δ which are previously specified for the respective types, in a corresponding form (in the embodiment, the map is configured as a two-dimensional matrix of the nominal diameter of the threaded portion and the workpiece type (for example, the material of the metal shell)). For example, the map is stored in the ROM 43 in the form in which the map is incorporated into the source of the control program.

Thread starting position accuracy reflecting parameter obtaining means: obtains the value of a thread starting position accuracy reflecting parameter which is an apparatus parameter that reflects the starting position accuracy with respect to the joining position of the ground electrode of the threaded portion to be rolling-formed.

Rolling determining means: determines whether the thread rolling was adequately performed or not, on the basis of the value of an obtained rolling completion reflecting parameter.

Selection outputting means: selects a thread rolling completed workpiece W or assists the selection, on the basis of a result of the determination. The output destination is the monitor 47 or a workpiece discharging mechanism which is not shown.

Figure 2:
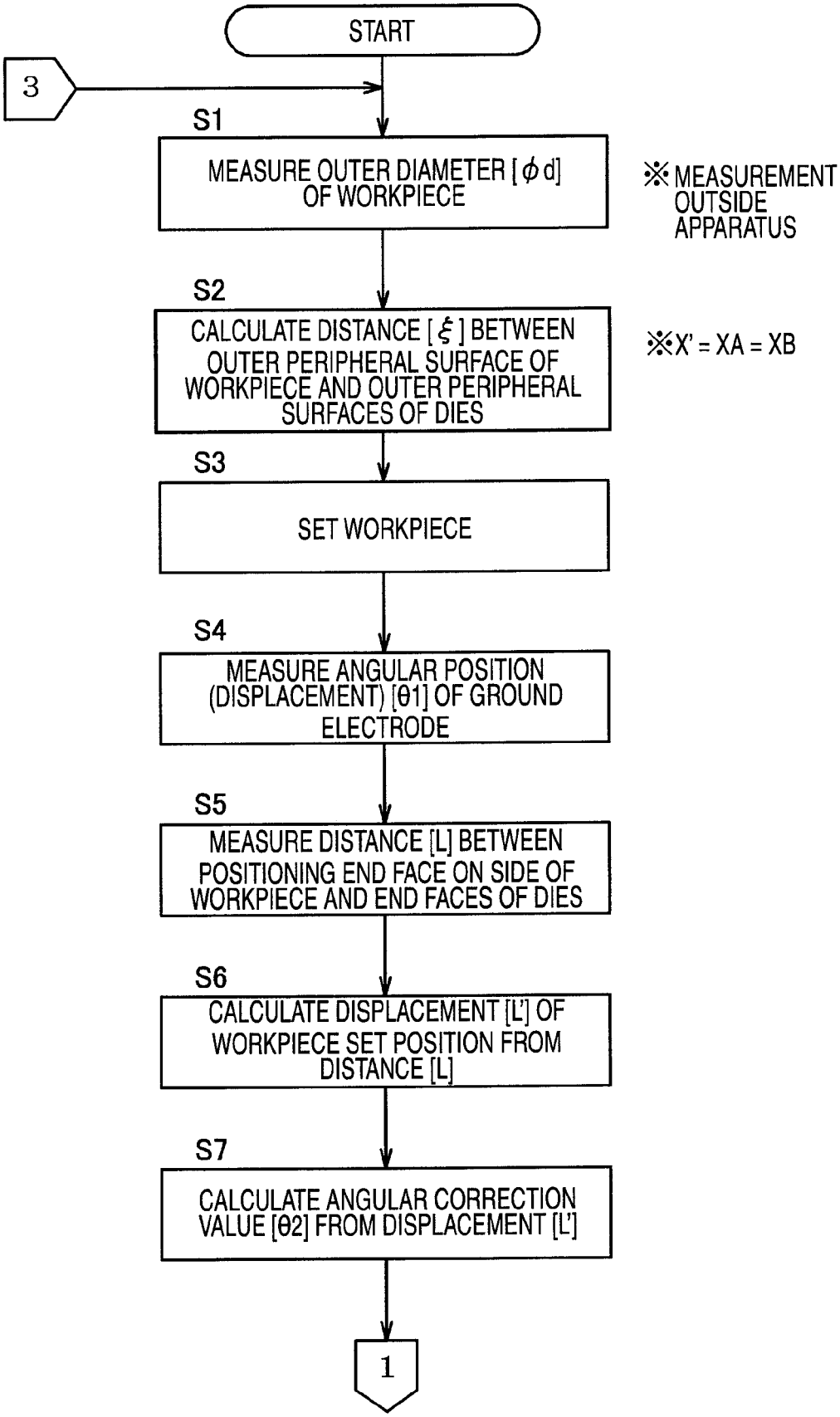
FIG. 2 is a flowchart showing the flow of the operation of the spark plug producing apparatus of FIG. 1.
Figure 3:
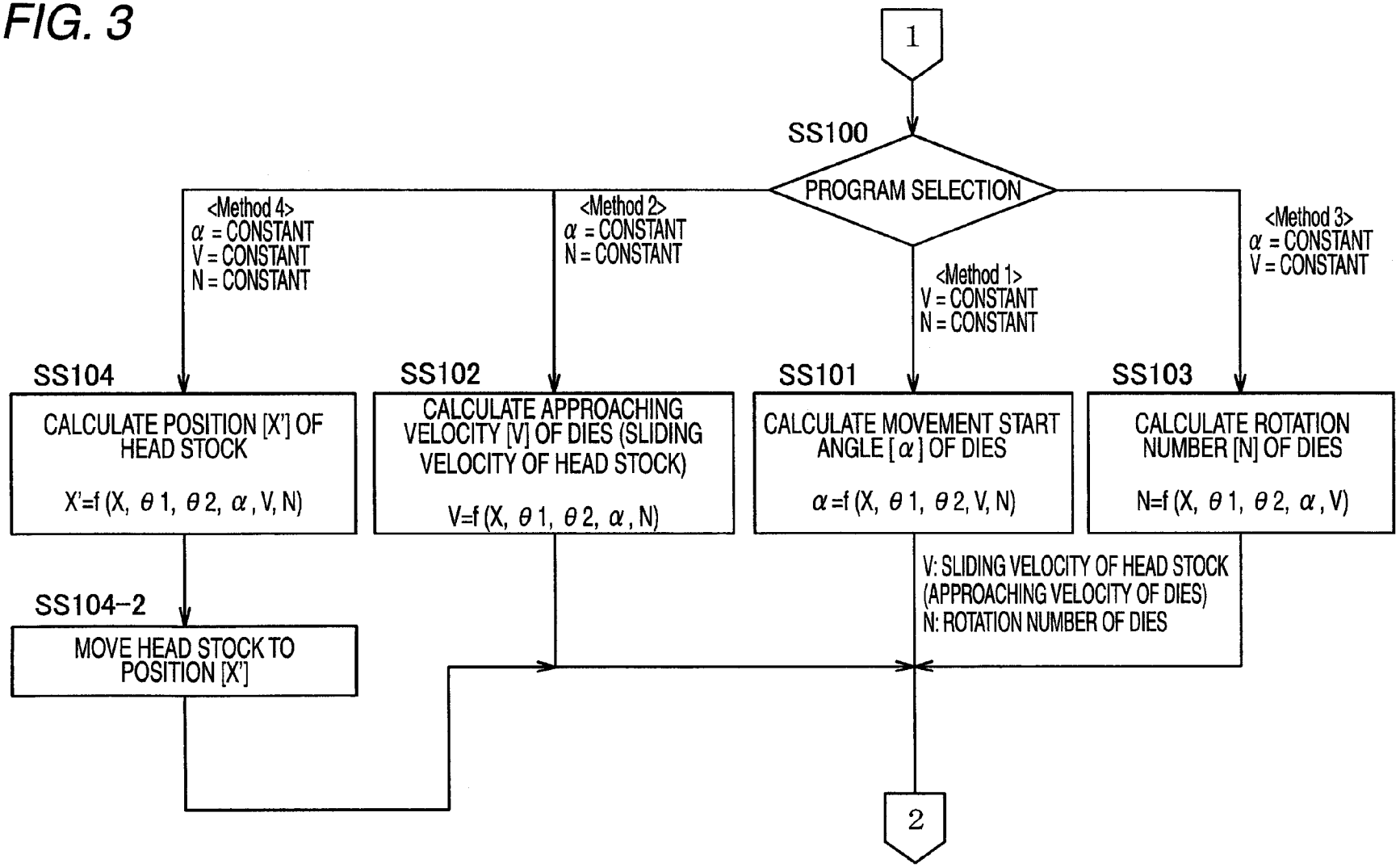
FIG. 3 is a flowchart subsequent to FIG. 2.
Figure 4:
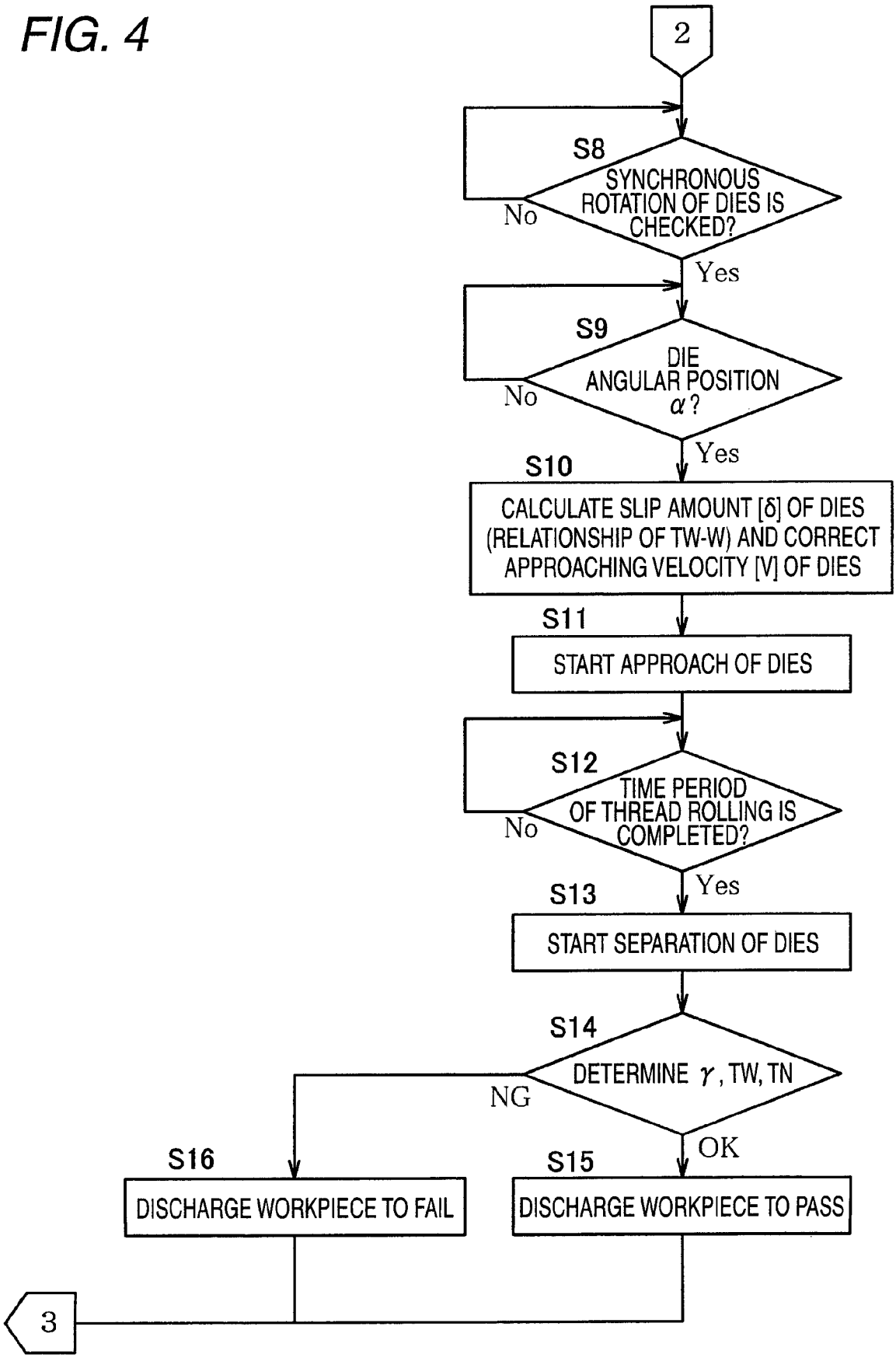
FIG. 4 is a flowchart subsequent to FIG. 3.

FIGS. 2, 3, and 4 are flowcharts showing the flow of the control program. Hereinafter, the operation of the spark plug producing apparatus 100 will be described with reference to the flowcharts. First, in S1, the outer diameter ϕd of the workpiece W (before the thread rolling) is measured outside the apparatus. In S2, the distance between the outer peripheral surface of the workpiece and the outer peripheral surfaces of the dies, i.e., an approach driving distance ξ is calculated on the basis of the encoder input values $X_A$, $X_B$ (the dies 27A, 27B are synchronously approach driven with respect to the approach/separation center G, and therefore $X_A=X_B$, and hereinafter generally merely indicated as X') and the value of the outer diameter ϕd (the value varies depending on the type of the workpiece).

Next, the workpiece W is set in S3 to the workpiece supporting portion 11. As shown in Step 1 of FIG. 5, plural workpieces W are conveyed by the workpiece feeder while being aligned so that opening end faces on the side of a hexagonal portion are flush with one another, and sequentially carried by a loader 60 to a workpiece attachment position with starting from the top. As shown in Step 2, the workpiece supporting portion 11 is advanced toward the workpiece W conveyed to the workpiece attachment position, and then attached to the inside through the opening on the side of the hexagonal portion. The position of the workpiece supporting portion 11 at this time is the retracting position P1.

Returning to FIG. 2, in S4, the angular position θ1 of the ground electrode of the workpiece W attached to the workpiece supporting portion 11 is measured. In a state where the workpiece supporting portion 11 supports the workpiece W, the portion is idly rotatable integrally with the workpiece W. The rotation position can be detected by an angle sensor 70 (an absolute rotary encoder). The workpiece supporting portion 11 is rotated about the center axis by a provisional rotary driving portion configured by a mortar and the like which are not shown. The angular position θ1 can be specified from an angle output (reference angular position: U) of the angle sensor 70 at the time when the ground electrode X is detected by the workpiece set detecting sensor 12.

Figure 6:
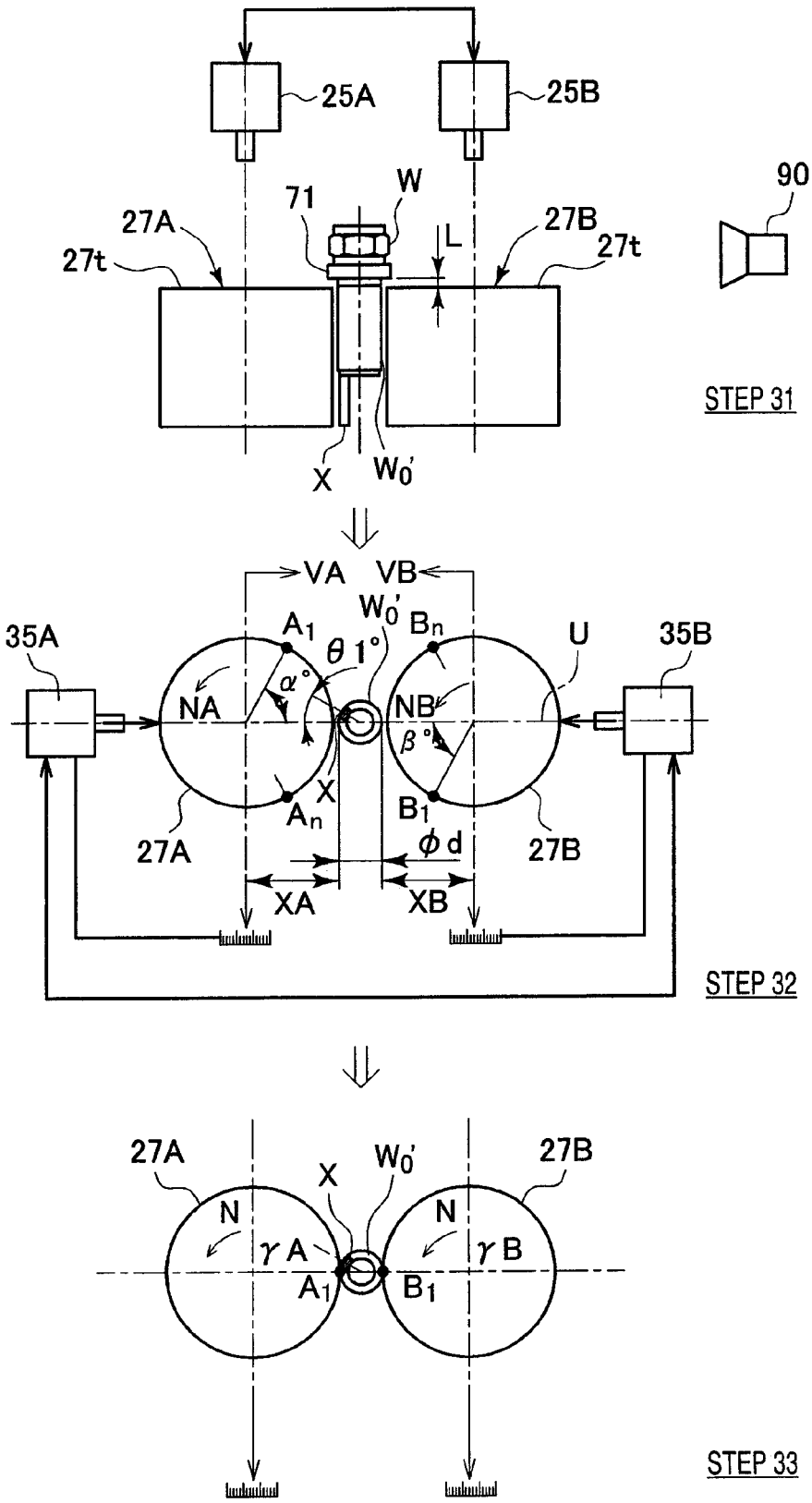
FIG. 6 is a diagram illustrating parameters which are used in a control.
Figure 7:
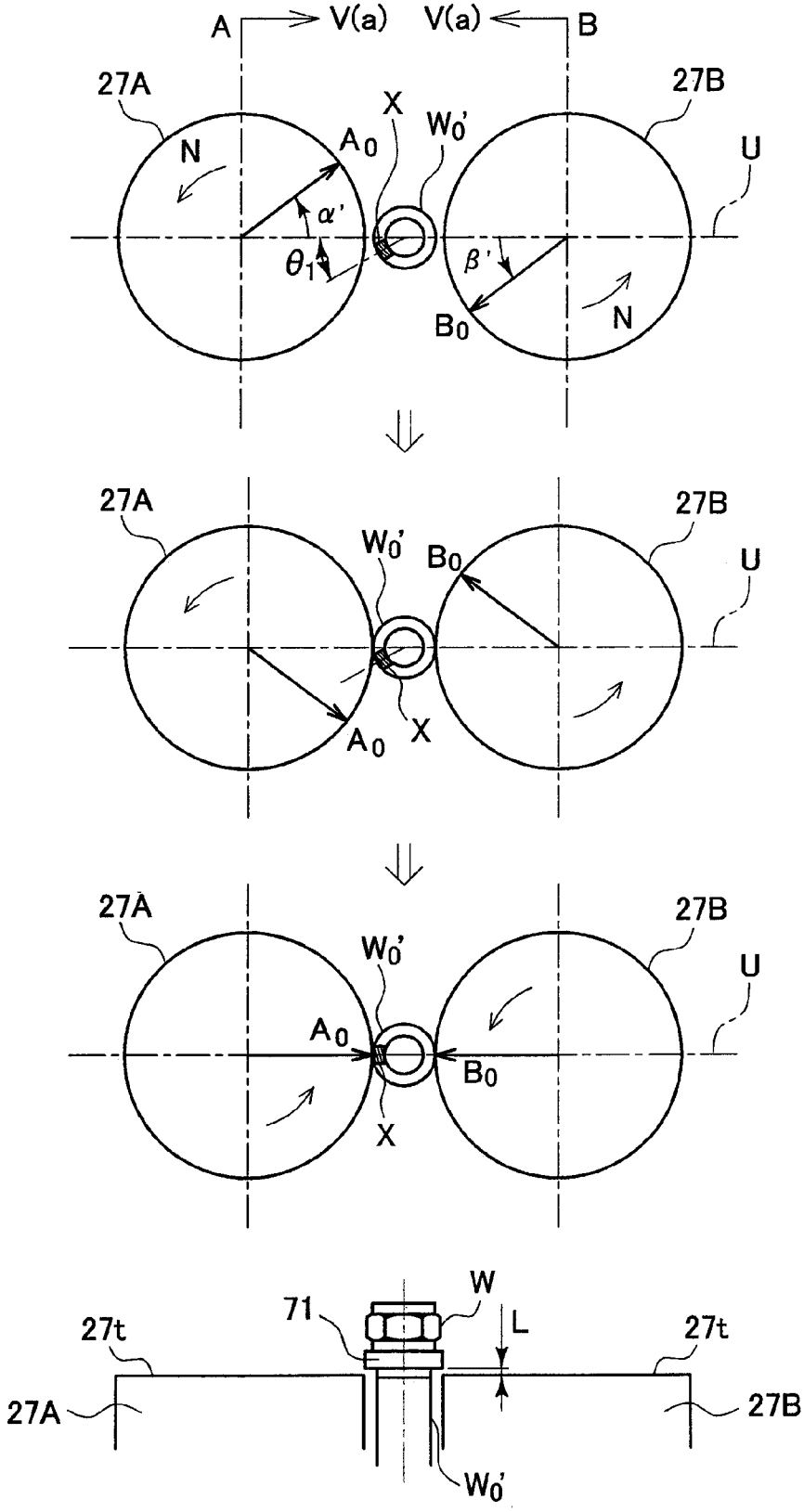
FIG. 7 is a first diagram illustrating the concept of calculation of approach driving conditions.

As shown in Step 31 of FIG. 6, the workpiece supporting portion 11 is feed-driven in the thrust direction, and conveyed to the rolling position P2 which is defined so that the rolling relief gap L of a constant size remains between the end face of the gas seal portion 71 on the side of the to-be-threaded portion W0', and the end faces of the dies 27A, 27B corresponding to the positioning end face on the side of the workpiece W. The feed driven position of the workpiece supporting portion 11 corresponding to the rolling position P2 is constant. When the attachment position of the workpiece W in the thrust direction with respect to the workpiece supporting portion 11 is dispersed, however, the rolling relief gap L is sometimes displaced from the target value. Therefore, the rolling relief gap displacement amount L' which is the displacement from the target value is measured, and approach driving is performed while conducting correction so that the L' is eliminated, thereby executing the rolling process. In the invention, the thrust correction for eliminating the rolling relief gap displacement amount L', and the approach driving toward the rolling positions of the dies 27A, 27B are simultaneously performed, so that the process can be shortened (Step 32→Step 33). In S5 of FIG. 2, first, the distance between the end face of the gas seal portion 71 on the side of the to-be-threaded portion W0' at the rolling position P2, and the end faces of the dies 27A, 27B corresponding to the positioning end face on the side of the workpiece W, i.e., the rolling relief gap L is specified from an image taken by the camera 90. In S6, the displacement from the target value is calculated as the rolling relief gap displacement amount L'. The angular displacements of the dies 27A, 27B which produce the screw advancement distance corresponding to the rolling relief gap displacement amount L' are calculated as a displacement corresponding angular displacement θ2 (S7).

The process proceeds to FIG. 3 to calculate the approach driving conditions. In the embodiment, for example, one of four calculating methods is adequately selected on the basis of information input from the input portion 48, and the calculation is performed. As shown in FIG. 1, individual calculation routines are separated from the main program routine.

Figure 8:
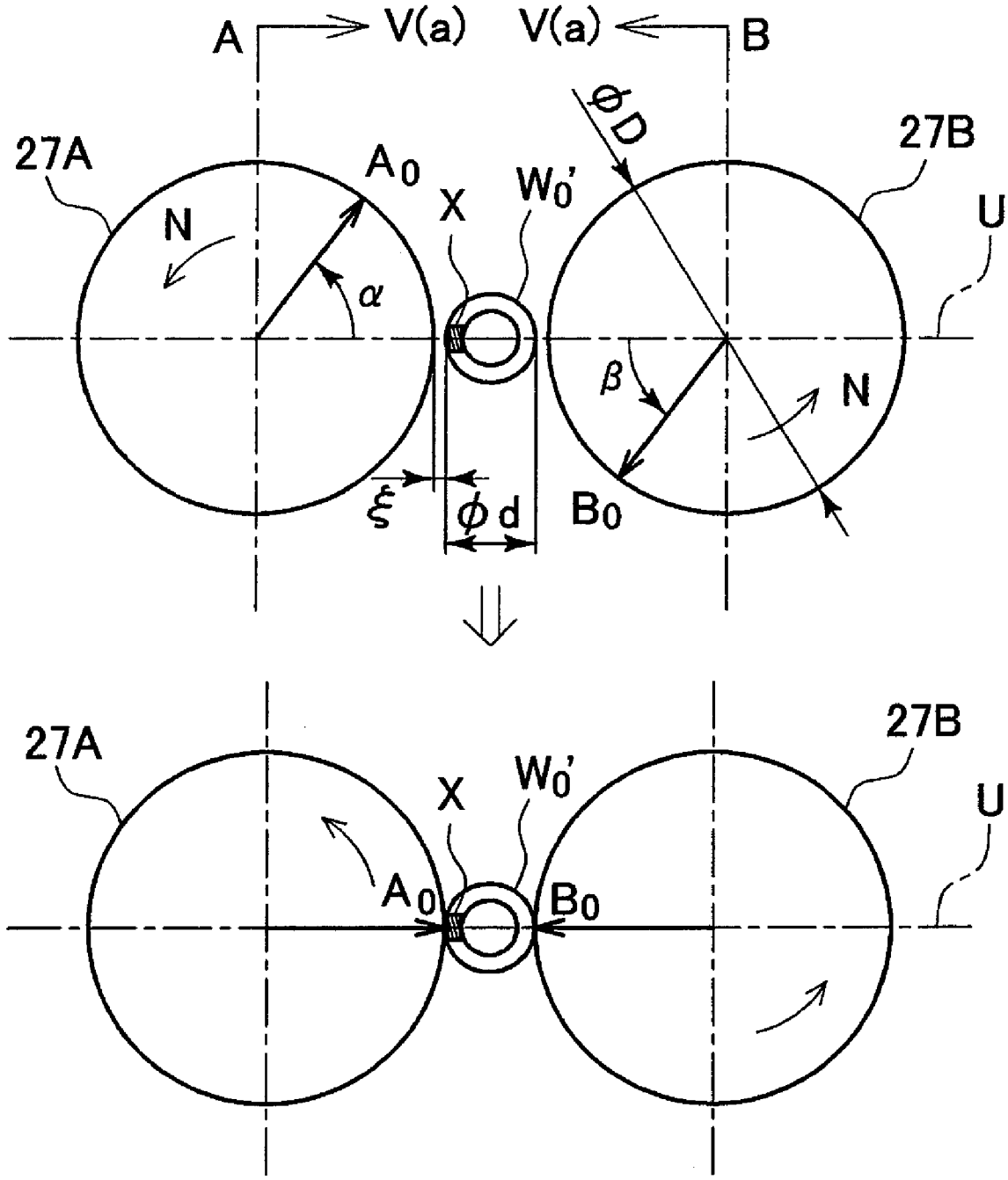
FIG. 8 is a second diagram illustrating the concept of the calculation of the approach driving conditions.

In Method 1 (SS101), the approaching velocity V of the dies 27A, 27B with respect to the workpiece W, and the rotational velocity N of the dies 27A, 27B are set as stipulated values, and a rotation starting angular position α of the dies 27A, 27B at the time when the approach driving is started is calculated and determined as a variable value corresponding to the rolling relief gap displacement amount L' (displacement corresponding angular displacement θ2) (parameters which are used also in the following description are shown in Step 32 of FIG. 6). As shown in FIG. 8, as described above, the approach driving distance ξ (mm/min) is already calculated, and the time period t (sec) which elapses until the workpiece is contacted with the dies is indicated by $$t=\xi/V \quad (1).$$

When the rotational velocity N (rpm) of the dies is used, the following is attained:

$$t=60m/N \quad (2)$$

where m is the number of rotations during the time period t. When (1) above is inserted, $$m=(\xi\cdot N)/(60V) \quad (3).$$

In the case where, as shown in FIG. 8, the angular position θ1 of the ground electrode X of the workpiece W is held constant, when the angular position θ1 is viewed from the origin position of the angle output ($\theta_A=\theta_B=\theta'$ because of the synchronous rotation) of the angle sensors 26A, 26B, for example, the thread rolling starting position is determined so as to coincide with the origin position U. Then, the angular position θ1 is zero in calculation. Taking as a reference an angular position when the dies are reversely rotated by the rotation number m from the origin position U, therefore, the position which is further rotated by the displacement corresponding angular displacement θ2 corresponding to L' can be determined as an approach starting angular position α(=β) (alternatively, m (angle conversion) may be corrected by the displacement corresponding angular displacement θ2 to be used as m'). In the case where the angular position θ1 is arbitrary, correction may be performed in which, as shown in FIG. 8, an approach starting angular position α' that is calculated while provisionally setting the angular position θ1 to be zero is added or reduced by the actual value of θ1 that is obtained by measurement. In place of the correction in which the approach starting angular position α is corrected by θ2, the workpiece W may be correction driven in the thrust direction so that L' itself is eliminated.

In Method 2 (SS102), next, the rotation starting angular position α of the dies 27A, 27B at the time when the approach driving is started, and the rotational velocity N of the dies 27A, 27B are set as stipulated values, and the relative approaching velocity V of the dies 27A, 27B with respect to the workpiece W is calculated and determined as a variable value corresponding to the rolling relief gap displacement amount L' (displacement corresponding angular displacement θ2). In this case, when m (angle conversion) is corrected in (3) above by the displacement corresponding angular displacement θ2 to be used as m', and the expression is solved for V, V can be calculated by $$V=(\xi\cdot N\cdot m')/60 \quad (3)'.$$

In Method 3 (SS103), the rotation starting angular position α of the dies 27A, 27B at the time when the approach driving is started, and the relative approaching velocity V of the dies 27A, 27B with respect to the workpiece W are set as stipulated values, and the rotational velocity N of the dies 27A, 27B is calculated and determined as a variable value corresponding to the rolling relief gap displacement amount L' (displacement corresponding angular displacement θ2). In this case, when (3) above is solved for N, N can be calculated by $$N=60V/(\xi\cdot m') \quad (3)''.$$

In Method 4 (SS104), the relative approaching velocity V of the dies 27A, 27B with respect to the workpiece W, the rotation starting angular position α of the dies 27A, 27B at the time when the approach driving is started, and the rotational velocity N of the dies 27A, 27B are set as stipulated values, and the approach driving distance X is calculated and determined as a variable value corresponding to the rolling relief gap displacement amount L' (displacement corresponding angular displacement θ2). In this case, all of α, V, and N are constant, and hence the distance is determined by making the dies to lead by θ2 above (the actual leading or lagging state of the angle depends on the sign of θ2) to lead by θ2, or by changing ξ as needed by a distance (both plus and minus are possible) required for displacing the feed of the workpiece from the target position by L'.

Referring to FIG. 4, in S8, the synchronous rotation of the dies 27A, 27B is checked (the checking can be made by coincidence of angle detecting input values $\theta_A$, $\theta_B$). In S9, it is checked whether the approach starting angular position α is reached or not. If reached, the process proceeds to S10 in which the angle slip amount δ corresponding to the obtained workpiece type is searched on the angle slip amount map 80 (FIG. 10), and the relative approaching velocity V of the dies 27A, 27B with respect to the workpiece W is corrected in accordance with the angle slip amount δ. As the angle slip amount δ is larger, the slip time period required until the dies 27A, 27B finally bite the workpiece W to be synchronously rotated is more prolonged. Therefore, the slip time period is calculated by the die rotation velocity N, and the relative approaching velocity V is corrected so that the slip time period is absorbed.

Figure 5:
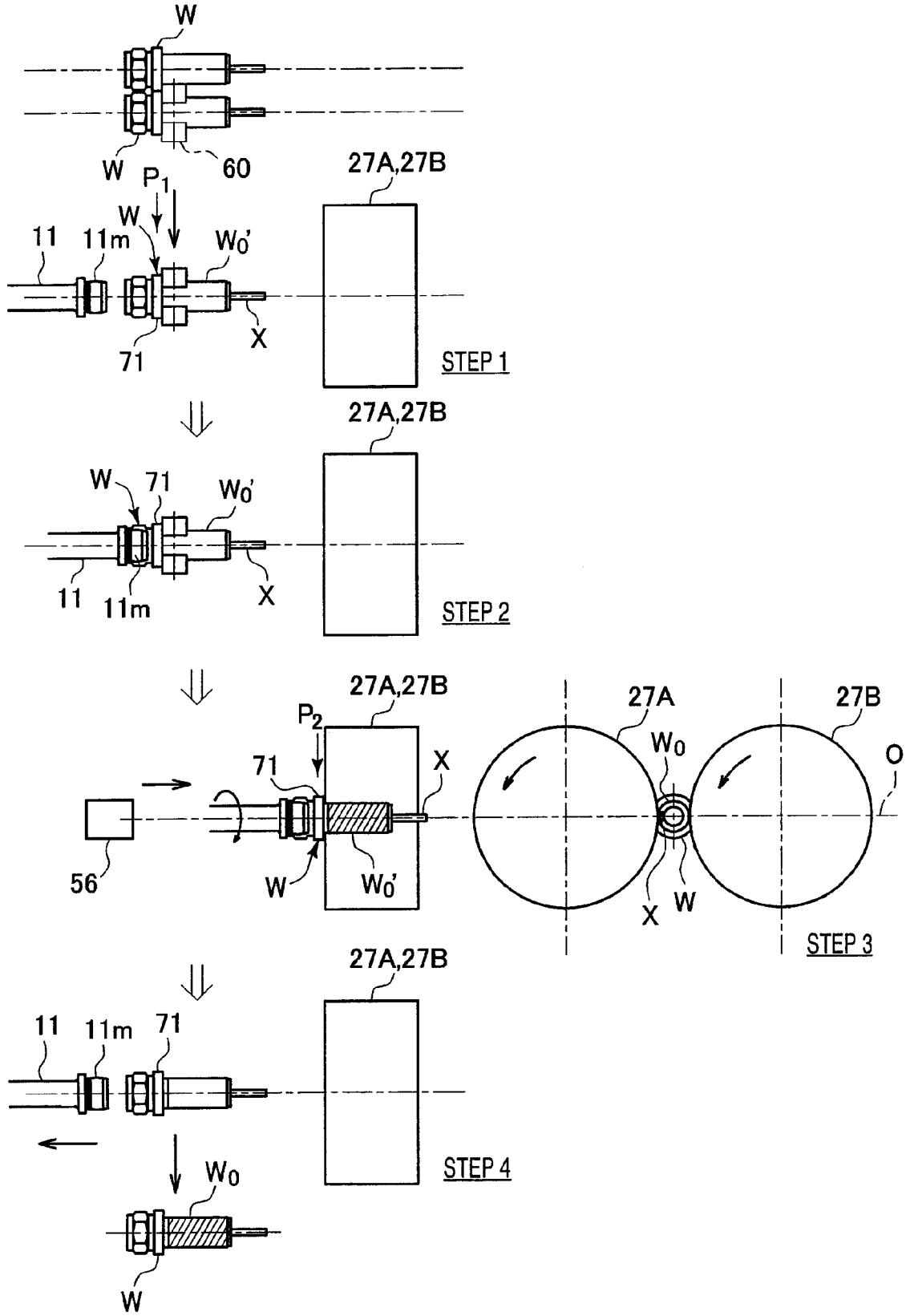
FIG. 5 is a schematic diagram of the operation of the spark plug producing apparatus of FIG. 1.

Then, the process proceeds to S11 in which the approach drive of the dies with respect to the workpiece is started (FIG. 5: Step 3). When the thread rolling is completed in S12, the process proceeds to S13 to start the separation of the dies. In S14, the thread starting position accuracy reflecting parameter is obtained, the process proceeds to a step in which it is determined whether the thread rolling is adequately performed or not, on the basis of the value of the obtained rolling completion reflecting parameter.

Specifically, an angular position γ (=$\gamma_A$, $\gamma_B$: FIG. 6) of the dies 27A, 27B at the completion of the approach drive is obtained as an abutting angular position of the dies 27A, 27B with respect to the outer peripheral surface of the workpiece W. When this value is not within a prescribed range, it is determined to be defective. A rolling load w which is applied from the dies 27A, 27B to the workpiece W is detected from a load sensor 71 (FIG. 1) configured by a strain gauge or the like disposed on a rotation drive shaft of a die or the like. A time period TW required until the rolling load w reaches a predetermined determination reference value is obtained as an apparatus parameter which reflects the angle slip amount δ with respect to the workpiece W. In the case where the time period TW is not within a prescribed range as shown in FIG. 9, it is determined to be defective.

Furthermore, the rotation velocities of the dies 27A, 27B and the workpiece W are detected by the angle sensors 26A, 26B, 70. The time period TN which elapses from the start of rotation of the workpiece W by co-rotation due to the rolling start until the rotation velocities coincide with one another, i.e., the time period which elapses until the dies 27A, 27B and the workpiece W are synchronously rotated is obtained as the apparatus parameter which reflects the angle slip amount δ with respect to the workpiece W. Also in the case where the time period TN is not within a prescribed range as shown in FIG. 9, it is determined to be defective. Only in the case where the time period does not correspond to both the determinations of defect, it is determined to be acceptable. The above-mentioned results are displayed on the monitor 47. In the case of determination of defect, the workpiece is discharged as a defective article (S16), and, in the case of determination of acceptance, the workpiece is discharged as an acceptable article (S15).

Hereinafter, various other embodiments in which the workpiece conveying means is mainly modified will be described.

FIGS. 11 to 14 respectively show examples in which, when a reference plane SP defined by the rotation axes $O_D$ of the dies and the center axis $O_W$ of the workpiece W which are parallel to one another at the rolling position P2 is considered, the workpiece conveying means is configured so as to convey the workpiece W from the retracting position P1 which is defined to be separated from the rolling position P2 in a direction intersecting the reference plane SP, to the rolling position P2.

Figure 11:
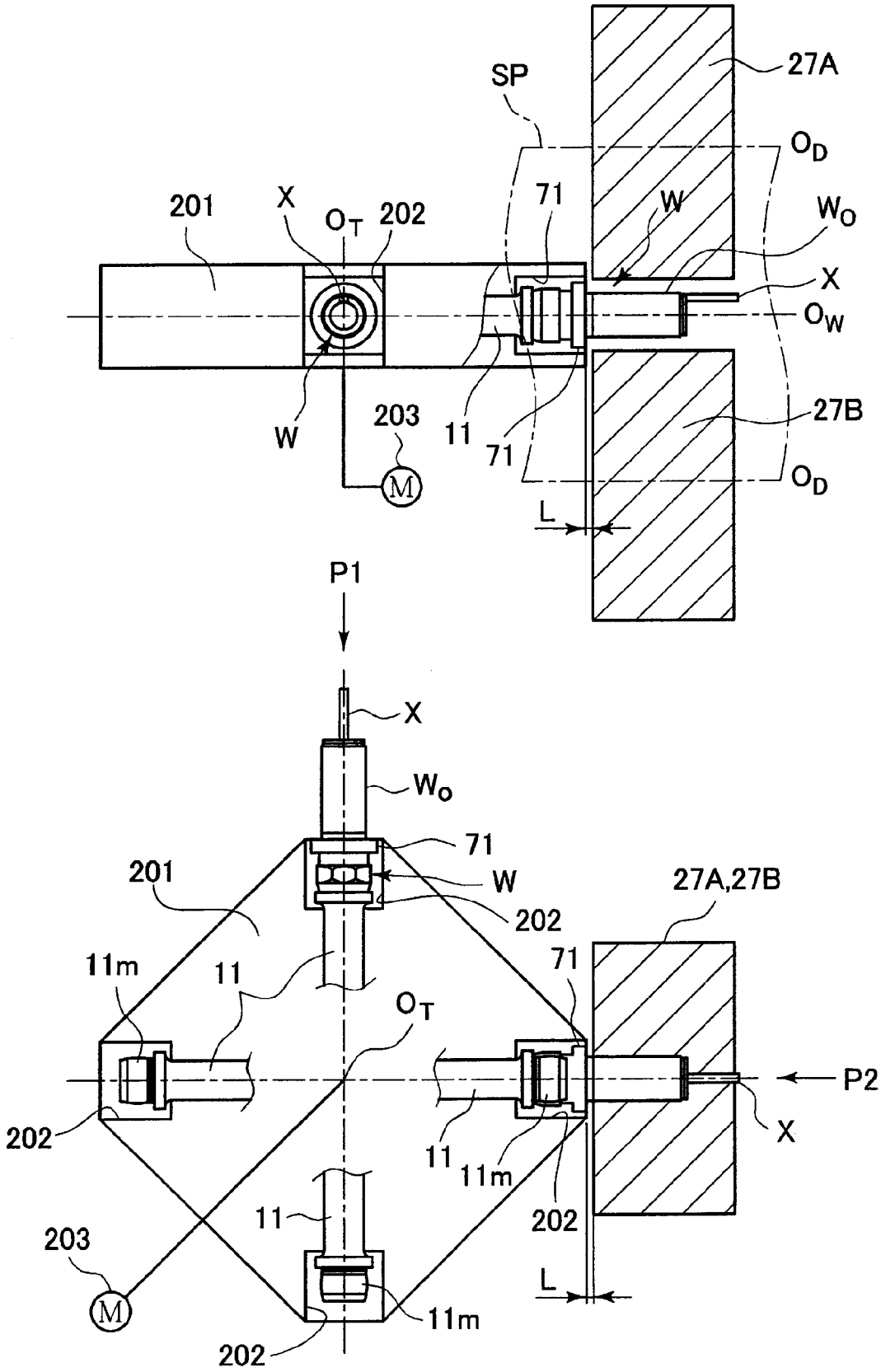
FIG. 11 is a diagram showing a first other example of workpiece conveying means.

First, the workpiece conveying means of FIG. 11 is an example in which the workpiece supporting portion 11 and the workpiece W supported thereon are integrally conveyed from the retracting position P1 which is defined to be separated from the rolling position P2, to the rolling position P2. Specifically, the means comprises a turret 201 which is placed rotatably about a rotation axis $O_T$ that perpendicularly intersects a predetermined position on an extension of the workpiece center axis $O_W$ on the side where the workpiece-side positioning end faces of the dies, in a plane passing through the workpiece center axis $O_W$ at the rolling position P2 and intersecting the reference plane SP. In an outer peripheral edge portion of the turret 201, the plural workpiece supporting portions 11 which support the workpieces W in a rotation radial direction of the turret 201 so that the to-be-threaded portions are projected from the outer peripheral surface of the turret 201 in the rotation radial direction are placed at predetermined angular intervals in the circumferential direction of the turret 201. A turret driving portion 203 (motor) which rotationally drives the turret 201 in an intermittent manner about the rotation axis so that the workpiece W attached to one of the plural workpiece supporting portions 11 is positioned at the rolling position P2, while setting the placement angular intervals of the workpiece supporting portions 11 as units. Because of the intermittent rotation drive of the turret 201, plural workpieces W can be efficiently conveyed to the rolling position P2, and the workpiece W which has undergone the rolling process can be rapidly discharged from the rolling position P2. The workpiece attaching process can be performed in parallel on a workpiece supporting portion which departs from the rolling position P2, by means of off-line setup while continuing the thread rolling process on the workpiece W at the rolling position P2.

Plural workpiece attachment recesses 202 which are opened in the outer peripheral surface of the turret 201 are formed in the turret 201 in a shape in which a rotation radial direction is set as the depth direction. In the embodiment, the turret 201 is formed into a plate-like shape in which a regular polygon is used as a base shape, and apex portions are cut off by an equal length (in the embodiment, an inequilateral octagonal shape in which the apexes of a square are cut off to form short side portions, and remaining side portions are long side portions). The workpiece attachment recesses 202 having a rectangle opening are formed in the cut-off apex portions.

In each of the workpiece attachment recesses 202, the workpiece supporting portion 11 is projectingly placed from the recess bottom toward the recess opening so that the position of the gas seal portion 71 of the supported workpiece W in the rotation radial direction is constant. Also in this case, the workpiece supporting portion 11 is configured as a mandrel stopper which inwardly holds the workpiece W by means of an elastic member such as a spring, and inserted into the opening side which is opposite to the side of the workpiece W where the ground electrode material X is joined. In the embodiment, in the workpiece supporting portion 11 built in the turret 201, however, the position in the rotation radial direction of the turret 201 is fixed, and means corresponding to the thrust feed driving means (the motor 55 in FIG. 1) is not disposed.

The positions of the workpiece supporting portions 11 of the turret 201 are adjusted so that, when the workpiece W is attached, the rolling relief gap when the position of the gas seal portion 71 is conveyed to the rolling position P2 has a value corresponding to the target value L (including dispersions corresponding to the workpiece attachment state). Therefore, the adjustment of the workpiece position corresponding to the target value L of the rolling relief gap is completed in a stage where the workpiece W is attached to the workpiece supporting portion 11 of the workpiece attachment recess 202 which is not at the rolling position P2. The rolling relief gap which is formed in this state is specified by means of imaging by the camera 90 (FIG. 1), and the rolling relief gap displacement amount L' is calculated. The thrust direction correction for eliminating this is performed mainly by the adjustment of the rotation angle phases of the dies 27A, 27B at the starting of the approach driving. In the case where the displacement of the rolling relief gap L with respect to the target value when the workpiece W is attached to the workpiece supporting portion 11 of the turret 201 is sufficiently small, the rolling relief gap L may be deemed constant, and the imaging of the rolling relief gap L by the camera 90 (FIG. 1) may be omitted (i.e., the measurement itself of the rolling relief gap may be omitted).

Figure 12:
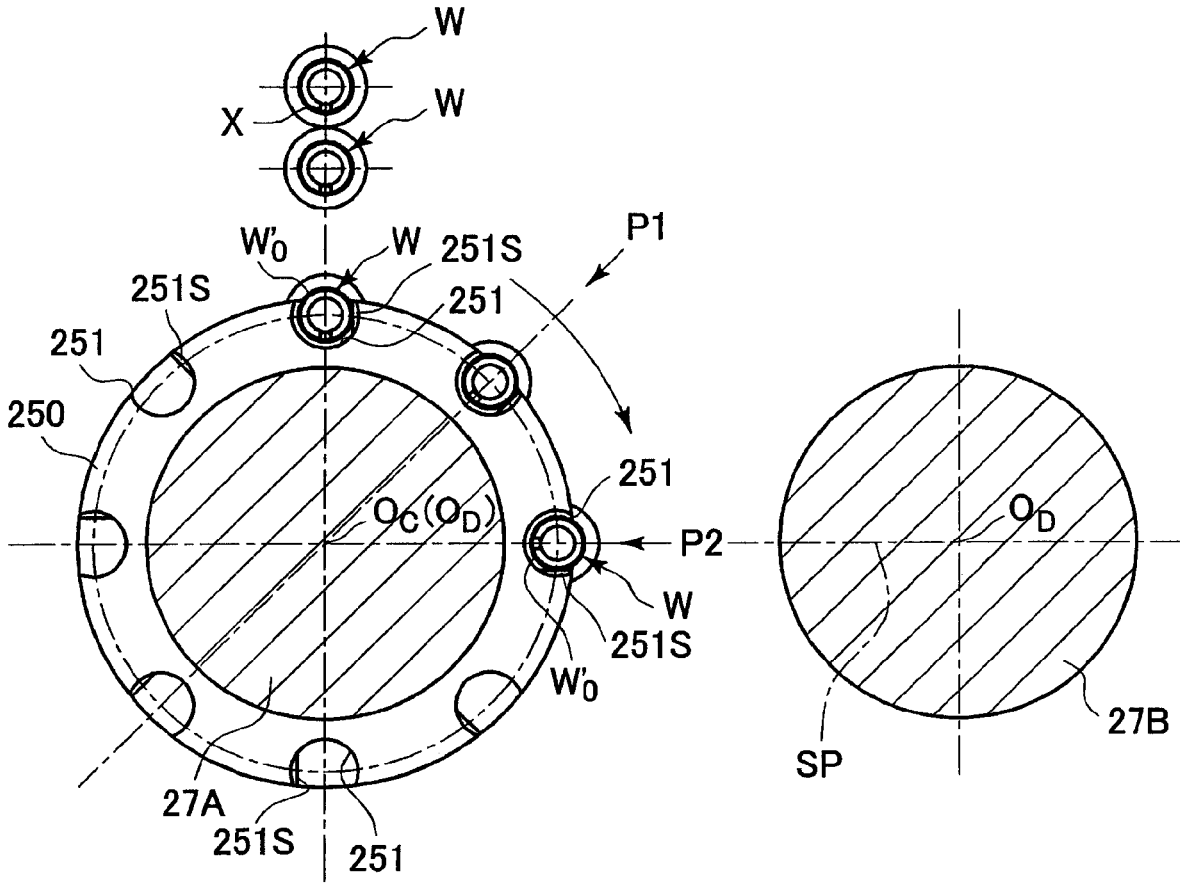
FIG. 12 is a diagram showing a second other example of the workpiece conveying means.
Figure 12:
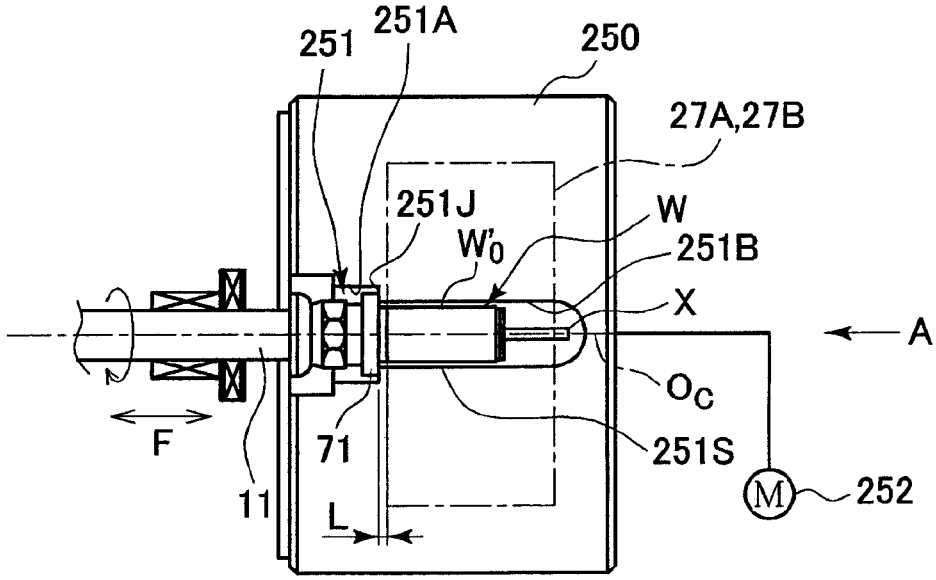

In the configuration shown in FIG. 12, the workpiece conveying means has a workpiece holder 250 in which plural workpiece attaching portions 251 for attaching the workpiece W are placed and formed on a cylindrical face in which the workpiece center axis $O_W$ at the rolling position P2 is one of the generatrices, in parallel to the center axis $O_C$ of the cylindrical face, and at predetermined intervals in the circumferential direction of the cylindrical face so that the positions of the gas seal portions 71 on the center axis direction are constant. A workpiece holder driving portion 252 (motor) which rotationally drives the workpiece holder 250 in an intermittent manner about the center axis of the cylindrical face, while setting the placement angular intervals of the workpiece attaching portions 251 as units is disposed.

In the embodiment, the workpiece holder 250 is configured as a cylindrical member which shares the center axis $O_C$ ($O_D$) with the one die 27A, and which is placed with being axially separated therefrom by a constant distance. The workpiece holder 250 can be reciprocally moved by a screw shaft mechanism or the like which is not shown, with respect to the dies 27A, 27B. The die 27A can approach the workpiece W which is held by the workpiece holder 250, and which is at the rolling position P2, inside the workpiece holder 250.

Each of the workpiece attaching portions 251 which are formed in the outer peripheral surface of the workpiece holder 250 is configured by a groove-like recess which has an inner side face formed by a partial cylindrical face that is larger in diameter than the to-be-threaded portion W0' of the workpiece W, and which has an opening that allows the workpiece W to enter and exit. Workpiece gripping members 251 each of which urgingly holds the to-be-threaded portion W0' by a spring (not shown) in a manner that the portion is allowed to rotate about the axis of the workpiece W are individually disposed in the inner face of the recess.

As shown in the lower portion of FIG. 12, each of the workpiece attaching portions 251 on the workpiece holder 250 is opened in the rear end face of the workpiece holder 250, and the workpiece W is attached to the portion in a form where a rear end portion is projected therefrom. An opening portion 251A in the rear end is larger in diameter than a main portion 251B in which the to-be-threaded portion W0' is to be accommodated, and, at a boundary position therebetween, a workpiece stopper 251J configured by a step is formed. The workpiece W is attached by means of off-line setup to the workpiece attaching portion 251 which is not at the rolling position, and transported to the rolling position by rotation of the workpiece holder 250. During this process, the die 27A is in a state where it is retracted to the rear of the rolling position.

In the rear of the workpiece attaching portion 251 at the rolling position, the workpiece supporting portion 11 waits at a preparation position which is situated behind the rear end face of the workpiece W in the direction of the center axis $O_W$ of the workpiece W. When the workpiece holder 250 is rotated and the workpiece W to be processed is transported to the rolling position P2, the workpiece supporting portion 11 advances to be attached to the workpiece W while pressing the front end face of the gas seal portion 71 toward the workpiece stopper 251J. At this time, the position of the gas seal portion 71 is determined so that the workpiece W is positioned at an approximate position corresponding to the target value L of the rolling relief gap. In this state, the formed rolling relief gap is specified by the imaging by the camera 90 (FIG. 1), and the rolling relief gap displacement amount L' is calculated. The thrust direction correction for eliminating this is performed by the reciprocal axial movement of the workpiece holder 250 by the above-described screw shaft mechanism (not shown) or the like, or the adjustment of the rotation angle phases of the dies 27A, 27B at the starting of the approach driving.

In the configuration shown in FIG. 12, the workpiece holder 250 may be placed so as to be immovable in the axial direction. In this case, the thrust direction correction for eliminating the rolling relief gap displacement amount L may be performed only by the adjustment of the rotation angle phases of the dies 27A, 27B at the starting of the approach driving. On the other hand, in the case the displacement of the rolling relief gap L with respect to the target value when the workpiece W is attached to the workpiece holder 250 in the form where it is butted against the workpiece stopper 251J is sufficiently small, the rolling relief gap L may be deemed constant, and the imaging of the rolling relief gap by the camera 90 (FIG. 1) may be omitted (i.e., the measurement itself of the rolling relief gap may be omitted).

Figure 13:
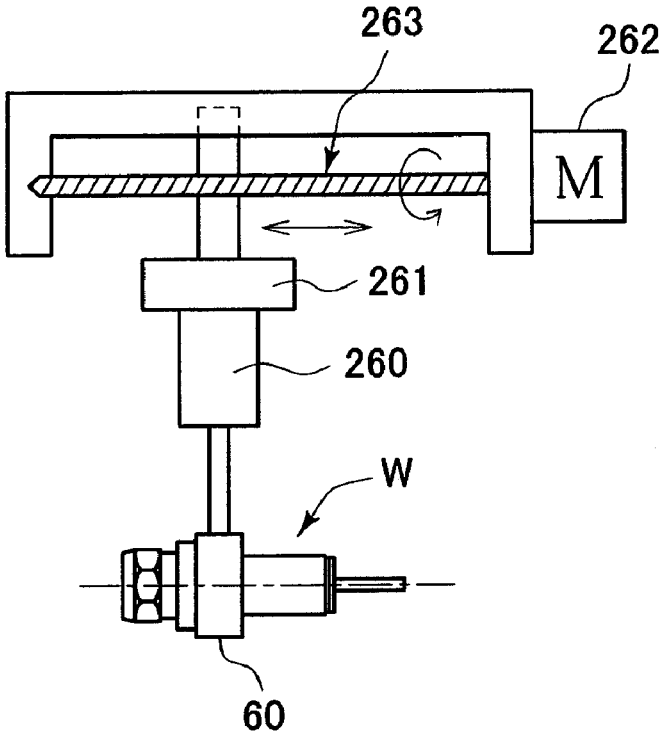
FIG. 13 is a diagram showing a third other example of the workpiece conveying means.
Figure 13:
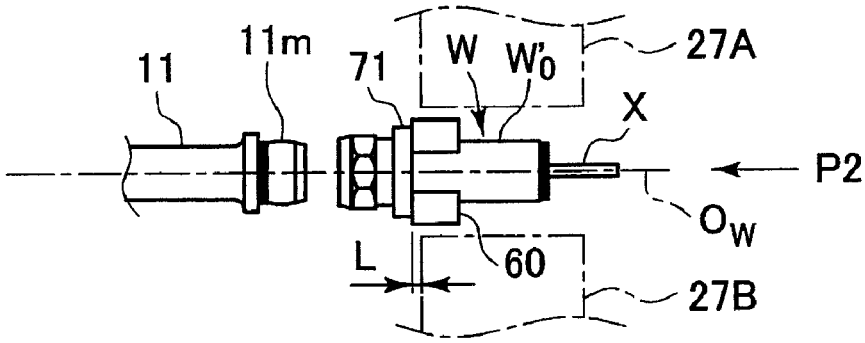

In FIG. 13, the workpiece conveying means is configured as means having a workpiece reciprocating mechanism 260 which reciprocates a workpiece gripping portion (loader) 60 that is to grip the workpiece W, and a workpiece gripping portion (loader) 60 that grips the workpiece W, between the retracting position P1 and the rolling position P2. The loader 60 gripping the workpiece W is correction driven by a workpiece gripping portion driving mechanism (means) 263 in the direction along which the relief gap displacement amount is eliminated in the direction of the center axis $O_W$ of the workpiece W. The loader 60 clampingly grips the workpiece W at the to-be-threaded portion W0' in a radial direction, by means of a well-known cylinder mechanism (not shown) or the like. In the embodiment, the workpiece W is gripped by the loader 60 at the retracting position which is situated above the rolling position P2, and lowered and positioned at the rolling position P2 by a lifting cylinder 260 which constitutes the workpiece reciprocating mechanism. At the rolling position P2, the rolling relief gap is specified by means of imaging by the camera 90 (FIG. 1), and the rolling relief gap displacement amount L' is calculated. The thrust direction correction for eliminating this is performed by integrally moving the loader 60 and the lifting cylinder 260 by the workpiece gripping portion driving mechanism 263. In the embodiment, the workpiece gripping portion driving mechanism 263 is configured as a screw shaft mechanism which is coupled to the lifting cylinder 260 via a base 261, and which is driven by a motor 262.

Figure 14:
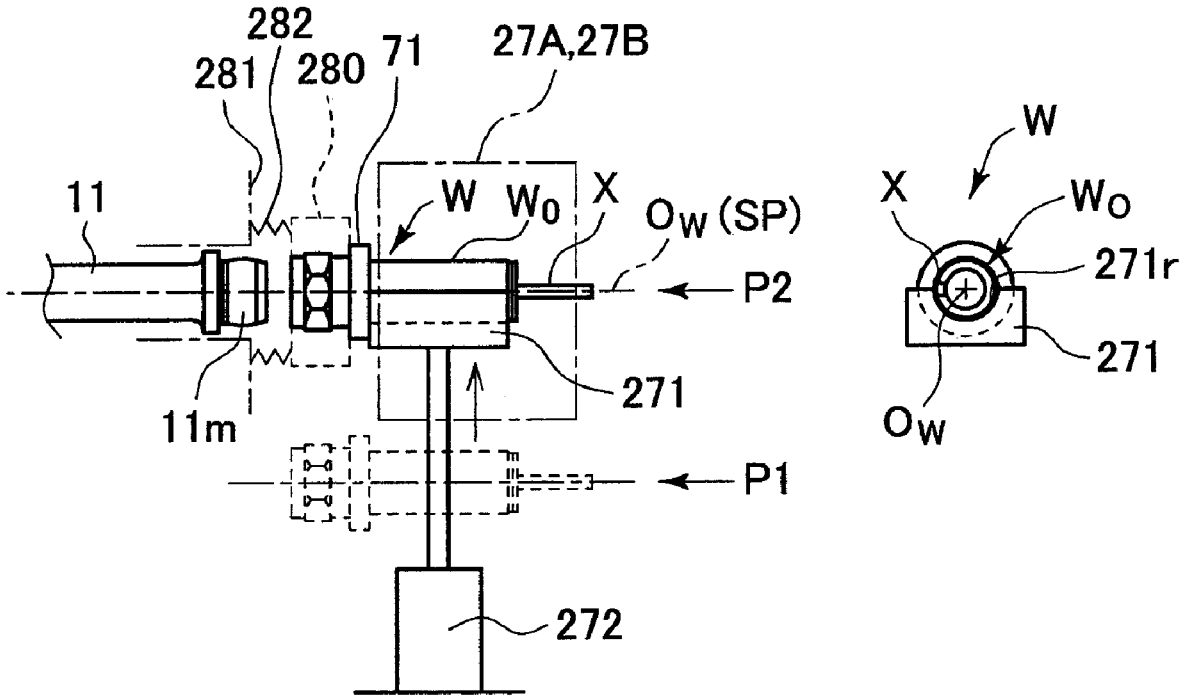
FIG. 14 is a diagram showing a fourth other example of the workpiece conveying means.

FIG. 14 shows an embodiment in which the workpiece conveying means liftingly conveys the workpiece W from the retracting position P1 which is below the rolling position P2, to the rolling position P2. At the retracting position P1, the workpiece W is loaded in a form where the to-be-threaded portion W0' is placed on the upper face of a workpiece attaching portion 271, and, in this state, the workpiece attaching portion 271 is lifted by a cylinder 272 and the workpiece W is positioned at the rolling position P2. In this state, the outer peripheral surface of the workpiece W is gripped by an urging gripping member 280, and the workpiece W is forward urged via the urging gripping member 280 by an elastic member 282 which is placed between the workpiece and a base portion 281. According to the configuration, the front end face of the gas seal portions 71 is positioned in the form where it is butted against the rear end face of the workpiece attaching portion 271.

Although the invention has been described in detail and with reference to the specific embodiments, it is obvious to those skilled in the art that various changes and modifications can be made without departing from the spirit and scope of the invention. The application is based on Japanese Patent Application (No. 2006-315924) filed Nov. 22, 2006 and Japanese Patent Application (No. 2007-298520) filed Nov. 16, 2007, and their disclosures are incorporated herein by reference.

The invention claimed is:

1. An apparatus for producing a spark plug, comprising:

a workpiece supporting portion for rotatably holding a workpiece about a center axis, said workpiece being a shaft-like workpiece which is to be formed as a metal shell of said spark plug, and in which a gas seal portion is formed on an outer peripheral surface of a basal end side of a to-be-threaded portion while being radially outward projected;

a die which is rotationally drivable in a rolling performing direction by die rotation driving means, for performing a thread rolling process on an outer peripheral surface of said workpiece held by said workpiece supporting portion;

workpiece conveying means for conveying said workpiece supporting portion, to which said workpiece is attachable, from a retracting position for preparation of rolling to a rolling position which is determined in a form where a predetermined rolling relief gap extending along the center axis of the workpiece remains between an end face of said gas seal portion on a side of said to-be-threaded portion, and an end face of said die corresponding to a positioning end face on a side of said workpiece;

approach driving means for, in order to start the thread rolling process, performing an approach drive of relatively approaching said die in a rotationally driven state and said workpiece to each other in a radial direction;

rolling relief gap displacement amount specifying means for, in advance of a start of the approach drive, measuring a value of the rolling relief gap formed between said workpiece conveyed to the rolling position and the die, and specifying a rolling relief gap displacement amount which is a displacement amount from a target value of said rolling relief gap;

thrust direction correcting means for thrust-correcting a positional relationship between a threaded portion formed in said die and said workpiece, in a direction along which the specified rolling relief gap displacement amount is eliminated;

approach driving condition calculating means for calculating the approach driving conditions on a basis of the specified rolling relief gap displacement amount so that, in a circumferential direction of said workpiece, a positional relationship between a starting position of said threaded portion which is rolling-formed, and a joining position of a ground electrode to a tip end face of said workpiece is constant; and approach drive controlling means for controlling an operation of said approach driving means on the basis of the calculated approach driving conditions.

2. The apparatus for producing a spark plug according to claim 1, wherein said approach drive controlling means is adapted to control the operation of said approach driving means so that a temporal overlap occurs between a time period of execution of the approach drive and a time period of execution of the thrust correction.

3. The apparatus for producing a spark plug according to claim 1, wherein said workpiece conveying means is thrust feed driving means for feed-driving said workpiece supporting portion to which said workpiece is attachable, from the retracting position for preparation of rolling in a thrust direction, to convey said workpiece supporting portion to the rolling position which is determined in the form where the predetermined rolling relief gap remains between said end face of said gas seal portion on the side of said to-be-threaded portion, and said end face of said die corresponding to said positioning end face on the side of said workpiece.

4. The apparatus for producing a spark plug according to claim 1, wherein said workpiece conveying means is adapted to convey said workpiece from said retracting position which, when a reference plane defined by a rotation axis of said die and a center axis of said workpiece which are parallel to each other at said rolling position is considered, is defined to be separated from said rolling position in a direction intersecting said reference plane, to said rolling position.

5. The apparatus for producing a spark plug according to claim 4, wherein said workpiece conveying means has: a workpiece holder in which plural workpiece attaching portions for attaching said workpiece are placed and formed on a cylindrical face in which a workpiece center axis at said rolling position is one of generatrices, in parallel to a center axis of said cylindrical face, and at predetermined intervals in the circumferential direction of said cylindrical face so that positions of said gas seal portions on the center axis direction are constant; and a workpiece holder driving portion for rotationally driving said workpiece holders in an intermittent manner about the center axis of said cylindrical face so that said workpiece attached to one of said plural workpiece attaching portions is positioned at said rolling position, while setting placement angular intervals of said workpiece attaching portions as units.

6. The apparatus for producing a spark plug according to claim 1, wherein said thrust direction correcting means is adapted to correct a rotation angle phase of said die at starting of the approach driving in the direction along which the rolling relief gap displacement amount is eliminated.

7. The apparatus for producing a spark plug according to claim 1, wherein said workpiece supporting portion is adapted to hold said workpiece integrally rotatably, and so that a phase of a holding angle of said ground electrode joining position of said workpiece about a rotation axis is constant.

8. The apparatus for producing a spark plug according to claim 7, wherein said workpiece supporting portion is adapted to hold said workpiece integrally rotatably, and so that a phase of a holding angle of said ground electrode joining position of said workpiece about the rotation axis is arbitrary, and has ground electrode joining position angle specifying means for specifying an attachment angular position of said ground electrode joining position of said workpiece attached to said workpiece supporting portion, with respect to said workpiece supporting portion, and said approach driving condition calculating means is adapted to calculate the approach driving conditions on the basis of said specified attachment angular position and the rolling relief gap displacement amount.

9. The apparatus for producing a spark plug according to claim 1, wherein said approach driving means is adapted to cause said die and said workpiece to relatively approach and separate each other between said approach retracting position where said die is separated from said outer peripheral surface of said workpiece in the radial direction, and said rolling position where said die is butted against said outer peripheral surface of said workpiece to perform the thread rolling process, and, while setting three of: an approach driving distance which is a distance in a radial direction between said approach retracting position and said rolling position; a relative approaching velocity or acceleration of said die with respect to said workpiece; a rotation angle phase of said die at starting of the approach driving; and a rotation velocity of said die, as stipulated constant values, and setting a remaining one as a variable value corresponding to the rolling relief gap displacement amount, said approach driving condition calculating means performs calculation and determination on the basis of the rolling relief gap displacement amount and the three stipulated values.

10. The apparatus for producing a spark plug according to claim 9, wherein, while setting the approach driving distance constant, setting two of: the relative approaching velocity or acceleration of said die with respect to said workpiece; the rotation angle phase of said die at starting of the approach driving; and the rotation velocity of said die, as stipulated values, and setting a remaining one as a variable value corresponding to the rolling relief gap displacement amount, said approach driving condition calculating means performs calculation and determination on the basis of the two stipulated values, the approach driving distance, and the rolling relief gap displacement amount.

11. The apparatus for producing a spark plug according to claim 10, wherein said approach driving condition calculating means calculates and determines the rotation angle phase of said die at starting of the approach driving, as a variable value corresponding to the rolling relief gap displacement amount, when setting the relative approaching velocity or acceleration of said die with respect to said workpiece and the rotation velocity of said die as stipulated values.

12. The apparatus for producing a spark plug according to claim 9, wherein said approach driving condition calculating means has angle slip amount specifying means for specifying an angle slip amount of said die with respect to said workpiece in a case where, for the thread rolling, said die bites said workpiece, and calculates the approach driving conditions while correcting in accordance with the angle slip amount.

13. The apparatus for producing a spark plug according to claim 1, wherein said apparatus has:

thread starting position accuracy reflecting parameter obtaining means for obtaining a value of a thread starting position accuracy reflecting parameter which is an apparatus parameter that reflects a starting position accuracy with respect to said ground electrode joining position of said threaded portion to be rolling-formed;

rolling determining means for determining whether the thread rolling was adequately performed or not, on the basis of a value of an obtained rolling completion reflecting parameter; and selection outputting means for selecting a thread rolling completed workpiece or assisting the selection, on the basis of a result of the determination.

14. A method of producing a spark plug wherein thread rolling is performed on an outer peripheral surface of said metal shell by using an apparatus for producing a spark plug according to claim 1.

15. An apparatus for producing a spark plug, comprising:

a workpiece supporting portion for rotatably holding a workpiece about a center axis, said workpiece being a shaft-like workpiece which is to be formed as a metal shell of said spark plug, and in which a gas seal portion is formed on an outer peripheral surface of a basal end side of a to-be-threaded portion while being radially outward projected;

a die which is rotationally drivable in a rolling performing direction by die rotation driving means, for performing a thread rolling process on an outer peripheral surface of said workpiece when being held by said workpiece supporting portion;

workpiece conveying means for conveying said workpiece supporting portion, to which said workpiece is attachable, from a retracting position for preparation of rolling to a rolling position which is determined in a form where a constant rolling relief gap remains between an end face of a gas seal portion on a side of a to-be-threaded portion, and an end face of said die corresponding to a positioning end face on a side of said workpiece, conveying said workpiece from a retracting position which, when a reference plane defined by a rotation axis of said die and a center axis of said workpiece which are parallel to each other at said rolling position is considered, is defined to be separated from said rolling position in a direction intersecting said reference plane, to said rolling position while holding an axial direction position which gives a constant rolling relief gap;

approach driving means for, in order to start the thread rolling process, performing an approach drive of relatively approaching said die in a rotationally driven state and said workpiece to each other in a radial direction;

approach driving condition calculating means for calculating approach driving conditions on a basis of the rolling relief gap displacement amount so that, in a circumferential direction of said workpiece, a positional relationship between a starting position of said threaded portion which is rolling-formed, and a joining position of a ground electrode to a tip end face of said workpiece is constant; and approach drive controlling means for controlling an operation of said approach driving means on the basis of the calculated approach driving conditions.

16. The apparatus for producing a spark plug according to claim 15, wherein the rolling relief gap extends along the center axis of the workpiece.

* * * * *